US012807284B2

(12) United States Patent
Shirao et al.

(10) Patent No.: US 12,807,284 B2
(45) Date of Patent: Nov. 24, 2026

(54) VESSEL, VESSEL CONTROL DEVICE, VESSEL CONTROL METHOD, AND NONVOLATILE STORAGE MEDIUM STORING PROGRAM

(71) Applicant: NHK SPRING Co., Ltd., Yokohama (JP)

(72) Inventors: Masato Shirao, Yokohama (JP); Takafumi Kamiya, Yokohama (JP); Jun Tokushige, Yokohama (JP); Marino Sato, Yokohama (JP)

(73) Assignee: NHK SPRING CO., LTD., Yokohama (JP)

( * ) Notice: Subject to any disclaimer, the term of this patent is extended or adjusted under 35 U.S.C. 154(b) by 0 days.

(21) Appl. No.: 18/618,381

(22) Filed: Mar. 27, 2024

(65) Prior Publication Data

US 2024/0227993 A1 Jul. 11, 2024

Related U.S. Application Data

(63) Continuation of application No. PCT/JP2022/034386, filed on Sep. 14, 2022.

(30) Foreign Application Priority Data

Sep. 29, 2021 (JP) ..... 2021-159282

(51) Int. Cl.
*B63B 49/00* (2006.01)
*B63B 79/40* (2020.01)
(Continued)

(52) U.S. Cl.
CPC ..... *B63B 49/00* (2013.01); *B63B 79/40* (2020.01); *B63C 9/0005* (2013.01); *B63H 21/21* (2013.01); *B63H 2021/216* (2013.01)

(58) Field of Classification Search
CPC ..... B63B 49/00; B63B 79/40; B63C 9/0005; B63H 21/21; B63H 2021/216;
(Continued)

(56) References Cited

U.S. PATENT DOCUMENTS 5,268,844 A * 12/1993 Carver ..... G01C 21/22 701/538
6,230,642 B1 * 5/2001 McKenney ..... G05G 9/047 114/144 R
(Continued)

FOREIGN PATENT DOCUMENTS

EP 3671682 A1 6/2020
JP 2014024421 A 2/2014
(Continued)

OTHER PUBLICATIONS

International Search Report for International Application No. PCT/JP2022/034386; Mailed on Nov. 29, 2022; 4 pages.
(Continued)

*Primary Examiner* — Bhavesh V Amin
(74) *Attorney, Agent, or Firm* — CANTOR COLBURN LLP

(57) ABSTRACT

A vessel includes an actuator having a function of generating a propulsive force of a vessel and a function of generating a moment of the vessel and a vessel control device that operates the actuator, wherein the vessel control device can perform automatic cruise control and fixed-point holding control of the vessel and includes a fixed-point holding target position setting unit that sets a fixed-point holding target position that is a target position of the vessel where the fixed-point holding control of the vessel is to be performed, and when the vessel control device performs automatic cruise control of the vessel and then performs fixed-point holding control of the vessel, the fixed-point holding target position setting unit sets a position different from an auto-
(Continued)

matic cruise stop position that is a position of the vessel where the automatic cruise control of the vessel is stopped as the fixed-point holding target position.

13 Claims, 14 Drawing Sheets

(51) Int. Cl.
*B63C 9/00* (2006.01)
*B63H 21/21* (2006.01)

(58) Field of Classification Search
CPC ..... B63H 25/02; B63H 25/04; B63H 25/42; B63H 25/50; G05D 3/00
See application file for complete search history.

(56) References Cited

U.S. PATENT DOCUMENTS 6,374,173 B1 * 4/2002 Ehlbeck ..... B60K 31/047 180/170
6,647,328 B2 * 11/2003 Walker ..... B60T 8/4266 701/2
6,990,401 B2 * 1/2006 Neiss ..... B60W 50/0097 701/96
7,186,155 B2 * 3/2007 Nickerson ..... B63H 25/36 440/61 S
7,238,071 B2 * 7/2007 Takada ..... B63H 20/14 440/86
7,259,357 B2 * 8/2007 Walker ..... B60R 25/042 156/499
7,267,068 B2 * 9/2007 Bradley ..... B63H 25/42 114/144 R
7,305,928 B2 * 12/2007 Bradley ..... B63H 25/42 114/144 R
7,389,735 B2 * 6/2008 Kaji ..... B63B 21/00 114/230.1
7,877,174 B2 * 1/2011 Walser ..... B63B 49/00 440/1
8,145,371 B2 * 3/2012 Rae ..... B63B 79/10 701/21
8,386,091 B2 * 2/2013 Kristinsson ..... G07C 5/085 701/2
8,428,799 B2 * 4/2013 Cansiani ..... B63B 39/061 440/12.5
8,626,366 B2 * 1/2014 Noffsinger ..... G05D 1/0206 701/123
8,731,748 B2 * 5/2014 Haymart ..... G06F 16/148 701/540
9,156,536 B1 * 10/2015 Arbuckle ..... F02D 11/105
9,195,234 B2 * 11/2015 Stephens ..... G05D 1/0208
9,377,780 B1 * 6/2016 Arbuckle ..... G01C 21/20
9,487,139 B1 * 11/2016 Ishida ..... B60W 30/08
9,709,996 B2 * 7/2017 Ito ..... B63H 20/20
9,777,655 B1 * 10/2017 Arbuckle ..... F02D 41/1401
9,778,657 B2 * 10/2017 Tyers ..... G01C 21/203
9,994,172 B2 * 6/2018 Miller ..... B60R 16/0236
10,037,701 B2 * 7/2018 Harnett ..... B63B 43/18
10,167,798 B1 * 1/2019 Van Camp ..... F02D 41/10
10,198,005 B2 * 2/2019 Arbuckle ..... B63H 25/42
10,202,182 B2 * 2/2019 Ito ..... B63H 25/42
10,431,099 B2 * 10/2019 Stewart ..... G08G 3/02
10,481,602 B2 * 11/2019 Chandy ..... B62D 5/0424
10,723,431 B1 * 7/2020 Przybyl ..... G01S 19/52
10,850,616 B2 * 12/2020 Koebler ..... B60K 35/28
11,634,204 B2 * 4/2023 Akuzawa ..... G05D 1/0206 701/21
11,747,162 B2 * 9/2023 Aggoune ..... G01C 21/3697 701/439
11,866,141 B2 * 1/2024 Ueno ..... G05D 1/0061
11,873,067 B2 * 1/2024 Ueno ..... G05D 1/0206
11,904,880 B2 * 2/2024 Aggoune ..... B60W 50/14
12,264,926 B2 * 4/2025 Bhasme ..... G01C 21/3461
2001/0056544 A1 * 12/2001 Walker ..... B60R 25/102 180/170
2004/0049324 A1 * 3/2004 Walker ..... B60T 7/18 701/1
2004/0068359 A1 * 4/2004 Neiss ..... G05B 13/048 180/170
2004/0121661 A1 * 6/2004 Okuyama ..... F02D 41/023 440/1
2004/0242091 A1 * 12/2004 Okuyama ..... B63H 21/21 440/86
2006/0009096 A1 * 1/2006 Takada ..... B63H 20/14 440/84
2006/0278152 A1 * 12/2006 Nickerson ..... B63H 25/22 114/144 R
2007/0073454 A1 * 3/2007 Kaji ..... G05D 1/0206 701/21
2008/0085642 A1 * 4/2008 Guglielmo ..... B63H 21/213 440/87
2008/0091309 A1 * 4/2008 Walker ..... B60R 25/102 701/1
2009/0069962 A1 * 3/2009 Aharon ..... B63H 25/46 701/21
2009/0209152 A1 * 8/2009 Walser ..... B63B 49/00 440/87
2010/0121539 A1 * 5/2010 Price ..... F02D 31/001 701/50
2010/0198435 A1 * 8/2010 Cansiani ..... B63B 39/061 701/21
2011/0213515 A1 * 9/2011 Haymart ..... A01K 97/00 707/769
2011/0270468 A1 * 11/2011 Kristinsson ..... G07C 5/008 701/2
2012/0078474 A1 * 3/2012 Price ..... F02D 41/0205 701/50
2012/0078490 A1 * 3/2012 Price ..... F02D 41/0205 701/103
2012/0277941 A1 * 11/2012 Noffsinger ..... G08G 3/00 701/21
2013/0110329 A1 * 5/2013 Kinoshita ..... G05D 1/0206 367/107
2014/0067226 A1 * 3/2014 Lee ..... G01C 21/3697 701/96
2014/0172208 A1 * 6/2014 Limbacher ..... B60W 50/08 903/902
2015/0089427 A1 * 3/2015 Akuzawa ..... G05D 1/0206 715/771
2015/0142227 A1 * 5/2015 Stephens ..... B63H 25/42 701/21
2015/0197247 A1 * 7/2015 Ichinokawa ..... B60W 30/143 701/93
2015/0292892 A1 * 10/2015 Claes ..... G01C 21/3492 701/533
2016/0125739 A1 * 5/2016 Stewart ..... B63B 43/18 701/301
2016/0207536 A1 * 7/2016 Yamaoka ..... B60W 50/10
2016/0280351 A1 * 9/2016 Ito ..... B63B 34/60
2017/0137103 A1 * 5/2017 Ito ..... B63H 20/00
2017/0144740 A1 * 5/2017 Ito ..... B63H 25/02
2017/0205829 A1 * 7/2017 Tyers ..... B63H 25/04
2017/0255201 A1 * 9/2017 Arbuckle ..... B63J 99/00
2017/0365175 A1 * 12/2017 Harnett ..... B63H 20/14
2018/0037117 A1 * 2/2018 Koebler ..... B60K 35/28
2018/0079304 A1 * 3/2018 Koebler ..... B60K 35/10
2018/0107214 A1 * 4/2018 Chandy ..... B62D 15/025
2018/0237118 A1 * 8/2018 Ito ..... B63H 21/21
2019/0039708 A1 * 2/2019 Hayes ..... B63H 25/24
2019/0205992 A1 * 7/2019 Brandman ..... G06Q 40/08
2019/0300138 A1 * 10/2019 Akuzawa ..... G05D 1/02
2020/0107030 A1 * 4/2020 Xia ..... H04N 19/164
2020/0407030 A1 * 12/2020 Ueno ..... B63B 79/10
2020/0407034 A1 * 12/2020 Ueno ..... B63H 21/213
2023/0064358 A1 * 3/2023 Poull ..... B60K 35/28
2023/0068356 A1 * 3/2023 Aggoune ..... G01C 21/3697
2023/0069732 A1 * 3/2023 Aggoune ..... B60W 50/14
2023/0341237 A1 * 10/2023 Aggoune ..... G01C 21/3697

(56) References Cited

U.S. PATENT DOCUMENTS

| | | | | |
|---|---|---|---|---|
| 2024/0002030 | A1* | 1/2024 | Inoue | B63H 25/42 |
| 2024/0227993 | A1* | 7/2024 | Shirao | B63B 79/40 |
| 2025/0216212 | A1* | 7/2025 | Ebner | G01C 21/3626 |

FOREIGN PATENT DOCUMENTS

| | | | |
|---|---|---|---|
| JP | 2017094945 | A | 6/2017 |
| JP | 2017178214 | A | 10/2017 |
| JP | 2019099114 | A | 6/2019 |
| JP | 2021041872 | A | 3/2021 |

OTHER PUBLICATIONS

JPO Notice of Reasons for Refusal for corresponding JP Application No. 2023-184109; Issued Mar. 5, 2025.

EPO Extended European Search Report for corresponding EP Application No. 22875834.8 issued Feb. 5, 2025.

* cited by examiner

FIXED-POINT HOLDING

TP2
TP2

ADVANCE WITH TENDENCY
TO KEEP MOVING
MONITOR VESSEL SPEED
SEAMLESS TRANSITION
COMFORTABLE CONTROL

STOP
AUTOMATIC CRUISE
TP1

DURING
AUTOMATIC CRUISE
1

TP1
FIXED-POINT HOLDING

TP2
TP2

ADVANCE WITH TENDENCY
TO KEEP MOVING
MONITOR VESSEL SPEED
SEAMLESS TRANSITION
COMFORTABLE CONTROL

STOP
AUTOMATIC CRUISE
TPX

DURING
AUTOMATIC CRUISE
1

ADVANCE WITH TENDENCY
TO KEEP MOVING
MONITOR VESSEL SPEED

STOP
AUTOMATIC CRUISE

DURING
AUTOMATIC CRUISE

RETURN TO TARGET POSITION RTP LARGE MOTION DISCOMFORT
ADVANCE WITH TENDENCY TO KEEP MOVING

STOP AUTOMATIC CRUISE
RTP
RTP

FIXED-POINT HOLDING

DURING AUTOMATIC CRUISE
R1

VESSEL, VESSEL CONTROL DEVICE, VESSEL CONTROL METHOD, AND NONVOLATILE STORAGE MEDIUM STORING PROGRAM

CROSS REFERENCE TO RELATED APPLICATIONS

This application is a continuation under 35 U.S.C. § 120 of PCT/JP2022/034386, filed Sep. 14, 2022, which is incorporated herein by reference, and which claimed priority to Japanese Application No. 2021-159282, Sep. 29, 2021. The present application likewise claims priority under 35 U.S.C. § 119 to Japanese Application No. 2021-159282, filed Sep. 29, 2021, the entire content of which is also incorporated herein by reference.

BACKGROUND OF THE INVENTION

Field of the Invention

The present invention relates to a vessel, a vessel control device, a vessel control method, and a nonvolatile storage medium storing a program.

Vessels in which a controller performs automatic cruise control are known in the related art (for example, see Patent Document 1). In a technology described in Patent Document 1, a destination of a vessel is set in automatic cruise control. Patent Document 1 also describes that automatic cruise control is stopped and fixed-point holding control is performed, and in the technology described in Patent Document 1, a target vessel speed is set to zero in the fixed-point holding control and a propulsion system is controlled to keep the vessel at the destination.

When automatic cruise control of a vessel is performed and then fixed-point holding control of the vessel is performed as in the technology described in Patent Document 1, an inertial force (a tendency to keep moving) of the vessel produced when the vessel, which was moving when the automatic cruise control of the vessel was being performed, attempts to stop remains at the time when the fixed-point holding control of the vessel is started. Thus, while the fixed-point holding control of the vessel is being performed, the vessel may pass the destination (which is a target position of automatic cruise control and fixed-point holding control) due to the inertial force (tendency to keep moving) of the vessel.

In the related art, to prevent the vessel from passing the target position of automatic cruise control and fixed-point holding control due to the inertial force (tendency to keep moving) of the vessel while the fixed-point holding control of the vessel is being performed, it is necessary to generate a thrust of the vessel in a direction against the inertial force (tendency to keep moving) or to perform complicated vessel speed control at the final stage of automatic cruise control of the vessel as in the technology described in Patent Document 1.

PATENT DOCUMENTS

[Patent Document 1] Japanese Unexamined Patent Application, First Publication No. 2017-094945

SUMMARY OF THE INVENTION

In view of the above problems, it is an object of the present invention to provide a vessel, a vessel control device, a vessel control method, and a program that can realize a smooth transition from automatic cruise control of the vessel to fixed-point holding control of the vessel while preventing generation of a thrust of the vessel in a direction against the inertial force (tendency to keep moving) of the vessel produced when transitioning from automatic cruise control of the vessel to fixed-point holding control of the vessel.

Specifically, it is an object of the present invention to provide a vessel, a vessel control device, a vessel control method, and a program that can realize a smooth transition from automatic cruise control of the vessel to fixed-point holding control of the vessel while preventing generation of a thrust of the vessel in a direction against the inertial force (tendency to keep moving) of the vessel produced when transitioning from automatic cruise control of the vessel to fixed-point holding control of the vessel, without the need to perform complicated vessel speed control at the final stage of automatic cruise control of the vessel unlike in the technology described in Patent Document 1.

An aspect of the present invention is a vessel including an actuator having a function of generating a propulsive force of a vessel and a function of generating a moment of the vessel, and a vessel control device configured to operate the actuator, wherein the vessel control device is configured to be able to perform automatic cruise control of the vessel and fixed-point holding control of the vessel, the vessel control device includes a fixed-point holding target position setting unit configured to set a fixed-point holding target position that is a target position of the vessel where the fixed-point holding control of the vessel is to be performed, and the fixed-point holding target position setting unit is configured to, when the vessel control device performs the automatic cruise control of the vessel and then performs the fixed-point holding control of the vessel, set a position different from an automatic cruise stop position that is a position of the vessel where the automatic cruise control of the vessel is stopped as the fixed-point holding target position.

An aspect of the present invention is a vessel control device that operates an actuator having a function of generating a propulsive force of a vessel and a function of generating a moment of the vessel, wherein the vessel control device is configured to be able to perform automatic cruise control of the vessel and fixed-point holding control of the vessel, the vessel control device includes a fixed-point holding target position setting unit configured to set a fixed-point holding target position that is a target position of the vessel where the fixed-point holding control of the vessel is to be performed, and the fixed-point holding target position setting unit is configured to, when the vessel control device performs the automatic cruise control of the vessel and then performs the fixed-point holding control of the vessel, set a position different from an automatic cruise stop position that is a position of the vessel where the automatic cruise control of the vessel is stopped as the fixed-point holding target position.

An aspect of the present invention is a vessel control method for a vessel control device that operates an actuator having a function of generating a propulsive force of a vessel and a function of generating a moment of the vessel, the vessel control method including performing automatic cruise control of the vessel by the vessel control device, performing fixed-point holding control of the vessel by the vessel control device, and setting, by the vessel control device, a fixed-point holding target position that is a target position of the vessel where the fixed-point holding control of the vessel is to be performed, wherein the setting includes setting, when the automatic cruise control is performed and then the fixed-point holding control is performed, a position different from an automatic cruise stop position that is a position of the vessel where the automatic cruise control of the vessel is stopped as the fixed-point holding target position.

An aspect of the present invention is a nonvolatile storage medium storing a program for a computer provided for a vessel control device that operates an actuator having a function of generating a propulsive force of a vessel and a function of generating a moment of the vessel to, the program causing the computer to perform automatic cruise control of the vessel, perform fixed-point holding control of the vessel, and set a fixed-point holding target position that is a target position of the vessel where the fixed-point holding control of the vessel is to be performed, wherein the setting includes setting, when the automatic cruise control is performed and then the fixed-point holding control is performed, a position different from an automatic cruise stop position that is a position of the vessel where the automatic cruise control of the vessel is stopped as the fixed-point holding target position.

According to the present invention, it is possible to provide a vessel, a vessel control device, a vessel control method, and a nonvolatile storage medium storing a program that can realize a smooth transition from automatic cruise control of the vessel to fixed-point holding control of the vessel while preventing generation of a thrust of the vessel in a direction against the inertial force (tendency to keep moving) of the vessel produced when transitioning from automatic cruise control of the vessel to fixed-point holding control of the vessel.

DETAILED DESCRIPTION OF THE INVENTION

A vessel control method of a comparative example will be described before describing embodiments of a vessel, a vessel control device, a vessel control method, and a program of the present invention.

FIG. 13A-FIG. 13E are diagrams showing the behavior of a vessel R1 of the comparative example when automatic cruise control is performed, and then fixed-point holding control is performed. FIG. 14 is a flowchart showing a process performed by the vessel R1 of the comparative example.

Figures 13A, 13B, 13C, 13D, 13E:
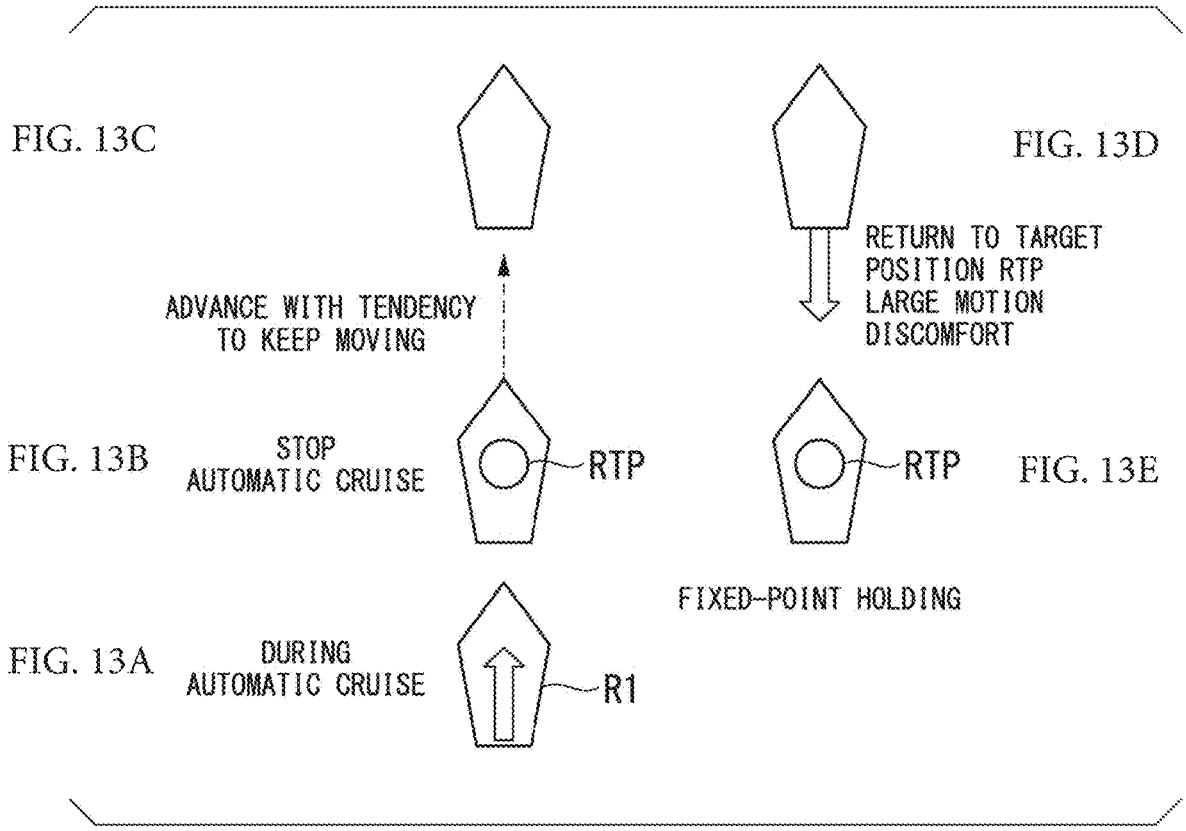
FIG. 13A-FIG. 13E are diagrams showing the behavior of a vessel of a comparative example when automatic cruise control is performed, and then fixed-point holding control is performed.
Figure 14:
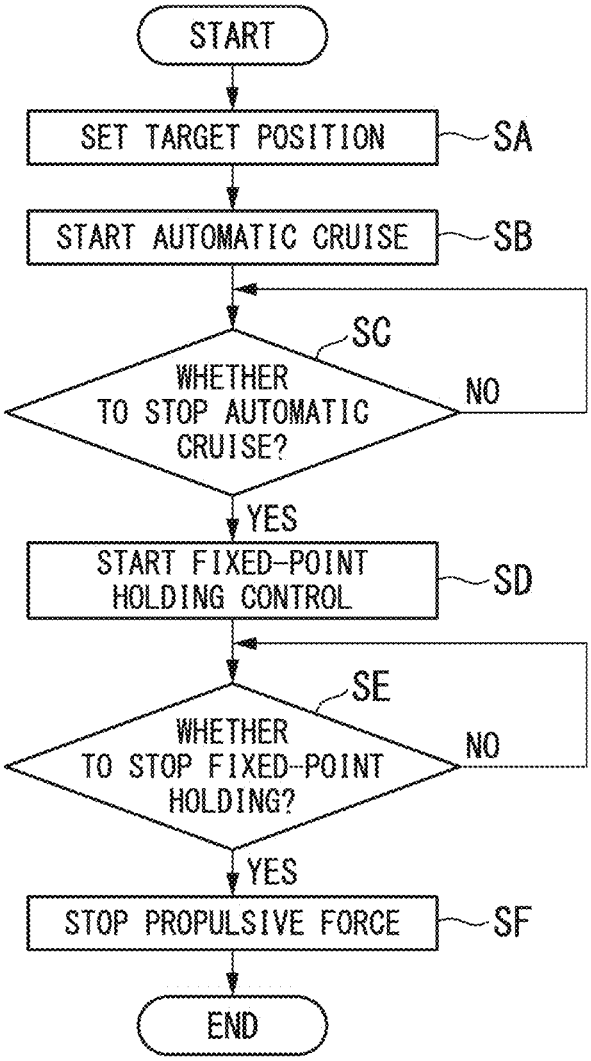
FIG. 14 is a flowchart showing a process performed by the vessel of the comparative example.

In the comparative example shown in FIGS. 13 and 14, in step SA in FIG. 14, a target position RTP of automatic cruise control and fixed-point holding control (see FIG. 13B) is set, for example, by an operator of the vessel R1.

Next, in step SB, the vessel R1 receives an automatic cruise start instruction, for example, from the operator of the vessel R1 and starts automatic cruise (that is, starts automatic cruise control of the vessel R1). As a result, the vessel R1 moves toward the target position RTP of automatic cruise control and fixed-point holding control as shown in FIG. 13A.

Next, in step SC, it is determined whether to stop the automatic cruise. Step SC is repeated when the vessel R1 has not reached the target position RTP of automatic cruise control and fixed-point holding control as shown in FIG. 13A. On the other hand, the automatic cruise is stopped (that is, the propulsive force of the vessel R1 is set to zero) when the vessel R1 has reached the target position RTP of automatic cruise control and fixed-point holding control as shown in FIG. 13B, and in step SD, fixed-point holding control of the vessel R1 is started. That is, the position of the vessel R1 when the automatic cruise control of the vessel R1 is stopped is the target position RTP of automatic cruise control and fixed-point holding control.

An inertial force (a tendency to keep moving) of the vessel R1 produced when the vessel R1, which was moving when the automatic cruise control of the vessel R1 was being performed, attempts to stop remains at the time when the fixed-point holding control of the vessel R1 is started. Thus, while the fixed-point holding control of the vessel R1 is being performed, the vessel R1 will pass the target position RTP of automatic cruise control and fixed-point holding control due to the inertial force (tendency to keep moving) of the vessel R1 as shown in FIG. 13C.

As a result, a propulsive force of the vessel R1 is generated in a direction (downward in FIG. 13) against the inertial force (tendency to keep moving) of the vessel R1 as shown by an arrow in FIG. 13D while fixed-point holding control of the vessel R1 is being performed. The greater the inertial force (tendency to keep moving) of the vessel R1 at the time when the fixed-point holding control of the vessel R1 is started, the greater the propulsive force of the vessel R1 in the direction against the inertial force (tendency to keep moving). Thus, occupants or the like of the vessel R1 who did not anticipate the generation of propulsive force of the vessel R1 in the direction against the inertial force (tendency to keep moving) may feel uncomfortable if the propulsive force of the vessel R1 in the direction against the inertial force (tendency to keep moving) is large.

Next, in step SE, it is determined whether to stop (end) the fixed-point holding control. Step SE is repeated when the vessel R1 has not returned to the target position RTP of automatic cruise control and fixed-point holding control as shown in FIG. 13D. On the other hand, the generation of the propulsive force of the vessel R1 is stopped (that is, the propulsive force of the vessel R1 is set to zero) in step SF when the vessel R1 has returned to the target position RTP of automatic cruise control and fixed-point holding control as shown in FIG. 13E.

First embodiment

Hereinafter, a first embodiment of a vessel, a vessel control device, a vessel control method, and a program of the present invention will be described.

Figure 1:
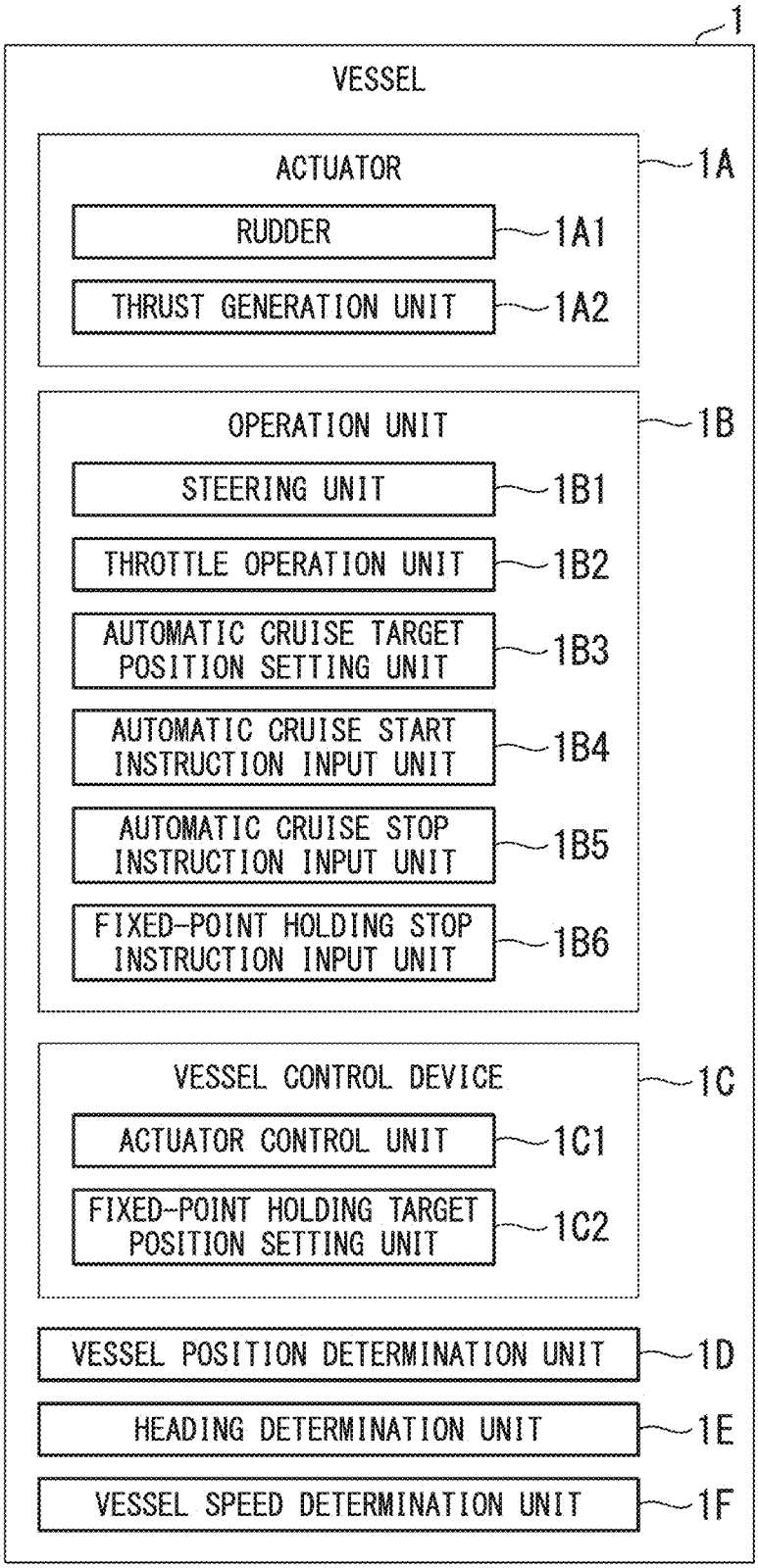
FIG. 1 is a diagram showing an example of a vessel to which a vessel control device of a first embodiment is applied.

FIG. 1 is a diagram showing an example of a vessel 1 to which a vessel control device 1C of the first embodiment is applied. The vessel control device 1C of the first embodiment is applicable to any type of vessel 1 such as, for example, a personal watercraft (PWC) having the same functions as a PWC shown in FIG. 1 of Japanese Patent No. 5196649 and a vessel not equipped with a jet propulsion device (such as, for example, a large vessel including a side thruster, a vessel including an inboard/outboard motor or an inboard engine, or a vessel equipped with an outboard motor described in Japanese Patent No. 6198192, Japanese Unexamined Patent Application, First Publication No. 2007-22284, or the like).

In the example shown in FIG. 1, the vessel 1 includes an actuator 1A, an operation unit 1B, a vessel control device 1C, a vessel position determination unit 1D, a heading determination unit 1E, and a vessel speed determination unit 1F.

The actuator 1A includes a rudder 1A1 and a thrust generation unit 1A2. The rudder 1A1 has a function of generating a moment of the vessel 1. The thrust generation unit 1A2 has a function of generating a propulsive force of the vessel 1.

In an example in which the vessel 1 is a PWC, the actuator 1A includes, for example, an engine, a nozzle, a deflector, a trim actuator, a bucket, a bucket actuator, or the like shown in FIG. 1 of Japanese Unexamined Patent Application, First Publication No. 2019-171925.

In the example shown in FIG. 1, the operation unit 1B receives an input of an operation (for example, an instruction) from an operator of the vessel 1 or the like. The operation unit 1B includes, for example, a steering unit 1B1, a throttle operation unit 1B2, an automatic cruise target position setting unit 1B3, an automatic cruise start instruction input unit 1B4, an automatic cruise stop instruction input unit 1B5, and a fixed-point holding stop instruction input unit 1B6. The steering unit 1B1 receives an input operation from the operator to operate the rudder 1A1. The throttle operation unit 1B2 receives an input operation from the operator to operate the thrust generation unit 1A2.

In an example in which the vessel 1 is a PWC, the steering unit 1B1 and the throttle operation unit 1B2 are configured similar to, for example, a steering handle device shown in FIG. 1 of Japanese Patent No. 5196649 or a steering unit shown in FIG. 1 of Japanese Unexamined Patent Application, First Publication No. 2019-171925.

In the example shown in FIG. 1, the automatic cruise target position setting unit 1B3 receives a setting of a target position of automatic cruise control of the vessel 1, for example, from the operator of the vessel 1 or the like. The automatic cruise start instruction input unit 1B4 receives an input of an instruction to start the automatic cruise control of the vessel 1, for example, from the operator of the vessel 1 or the like. The automatic cruise stop instruction input unit 1B5 receives an input of an instruction to stop the automatic cruise control of the vessel 1 from the operator of the vessel 1 or the like. The fixed-point holding stop instruction input unit 1B6 receives an input of an instruction to stop the fixed-point holding control of the vessel 1 from the operator of the vessel 1 or the like.

The vessel control device 1C performs control for operating the actuator 1A or the like based on an input operation that the operation unit 1B has received from the operator of the vessel 1 or the like. The vessel control device 1C can perform automatic cruise control of the vessel 1 and fixed-point holding control of the vessel 1. The vessel control device 1C includes an actuator control unit 1C1 and a fixed-point holding target position setting unit 1C2. The actuator control unit 1C1 controls the actuator 1A. That is, the actuator control unit 1C1 operates the actuator 1A. The fixed-point holding target position setting unit 1C2 sets a fixed-point holding target position which is a target position of the vessel 1 where fixed-point holding control of the vessel 1 is to be performed.

The vessel position determination unit 1D determines the position of the vessel 1. The vessel position determination unit 1D includes, for example, a global positioning system (GPS) device. The GPS device calculates the position coordinates of the vessel 1 by receiving signals from a plurality of GPS satellites.

The heading determination unit 1E determines the heading of the vessel 1. The heading determination unit 1E includes, for example, an orientation sensor. The orientation sensor calculates the heading of the vessel 1, for example, using geomagnetism.

In another example, the orientation sensor may be a device (a gyro compass) that is a gyroscope rotating at high speed with a pointing north device and a vibration damping device added such that it always points to north.

In yet another example, the orientation sensor may be a GPS compass that includes a plurality of GPS antennas and calculates the heading from the relative positional relationship of the plurality of GPS antennas.

In the example shown in FIG. 1, the vessel speed determination unit 1F determines the speed of the vessel 1. The vessel speed determination unit 1F may be of a water pressure sensing type that determines the speed of the vessel 1 relative to the water or may be of a GPS measurement type that determines the speed of the vessel 1 relative to the ground.

FIG. 2A-FIG. 2D are diagrams showing an example of the behavior of the vessel 1 when the vessel control device 1C of the first embodiment performs automatic cruise control and then performs fixed-point holding control. FIG. 3 is a flowchart showing an example of a process performed by the vessel 1 to which the vessel control device 1C of the first embodiment is applied.

In the example shown in FIG. 2A-FIG. 2D and FIG. 3, in step S11 of FIG. 3, the automatic cruise target position setting unit 1B3 receives a setting of an automatic cruise target position TP1 (see FIG. 2B), which is a target position of automatic cruise control of the vessel 1, for example, from the operator of the vessel 1 or the like.

Next, in step S12, the automatic cruise start instruction input unit 1B4 receives an input of an instruction to start automatic cruise control of the vessel 1, for example, from the operator of the vessel 1 or the like. As a result, the vessel control device 1C starts automatic cruise control of the vessel 1 (that is, the vessel 1 starts automatic cruise), and as shown in FIG. 2A, the vessel 1 moves toward the automatic cruise target position TP1.

Next, in step S13, the vessel control device 1C determines whether to stop the automatic cruise control of the vessel 1. Step S13 is repeated when the vessel control device 1C has determined that the automatic cruise control of the vessel 1 is not to be stopped (specifically when the position of the vessel 1 determined by the vessel position determination unit 1D does not approximately match the automatic cruise target position TP1 (that is, the vessel 1 has not reached the automatic cruise target position TP1) and the automatic cruise stop instruction input unit 1B5 has not received an input of an instruction to stop the automatic cruise control of the vessel 1 from the operator of the vessel 1 or the like). On the other hand, the process proceeds to step S14 when the vessel control device 1C has determined that the automatic cruise control of the vessel 1 is to be stopped (specifically when the position of the vessel 1 determined by the vessel position determination unit 1D approximately matches the automatic cruise target position TP1 (that is, the vessel 1 has reached the automatic cruise target position TP1) or when the automatic cruise stop instruction input unit 1B5 has received an input of an instruction to stop the automatic cruise control of the vessel 1 from the operator of the vessel 1 or the like).

Figures 2A, 2B, 2C, 2D:
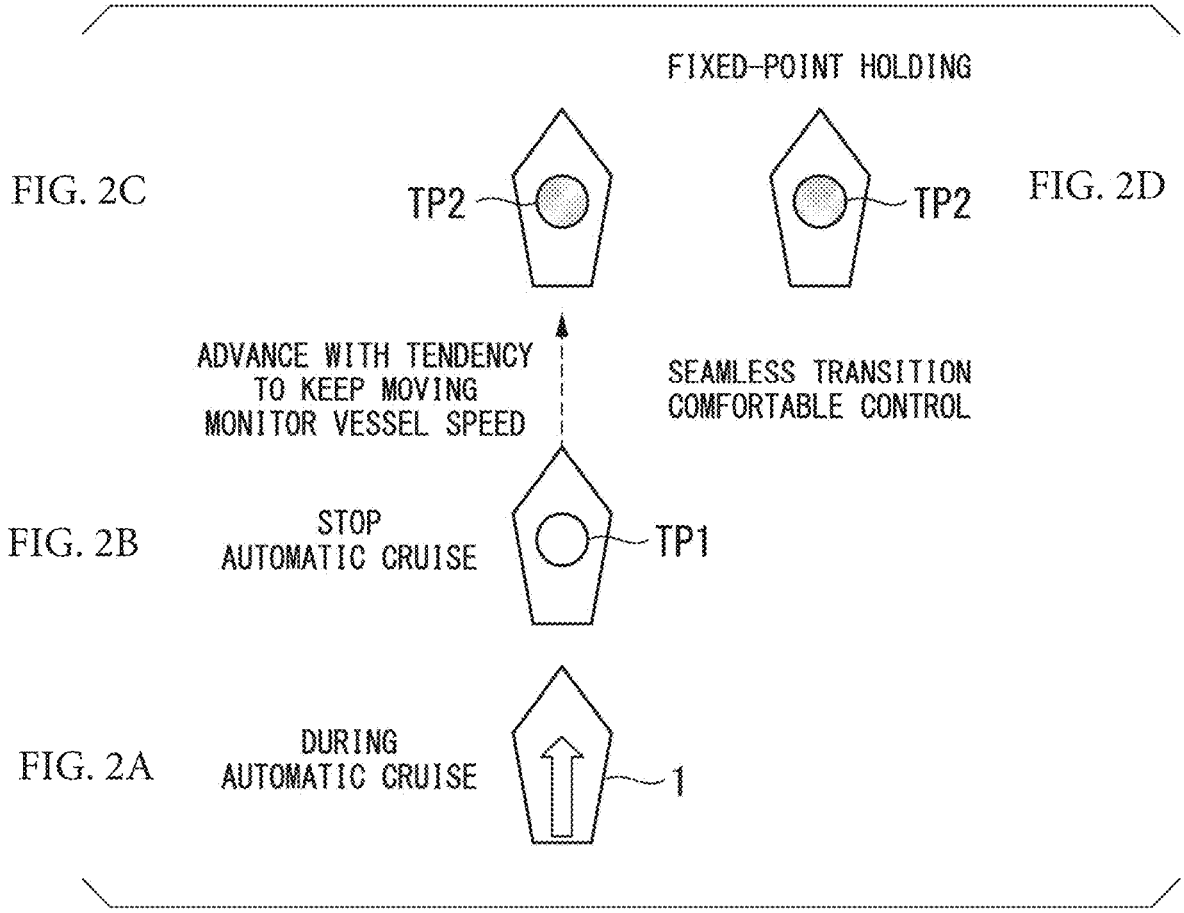
FIG. 2A-FIG. 2D are diagrams showing an example of the behavior of a vessel when the vessel control device of the first embodiment performs automatic cruise control and then performs fixed-point holding control.
Figure 3:
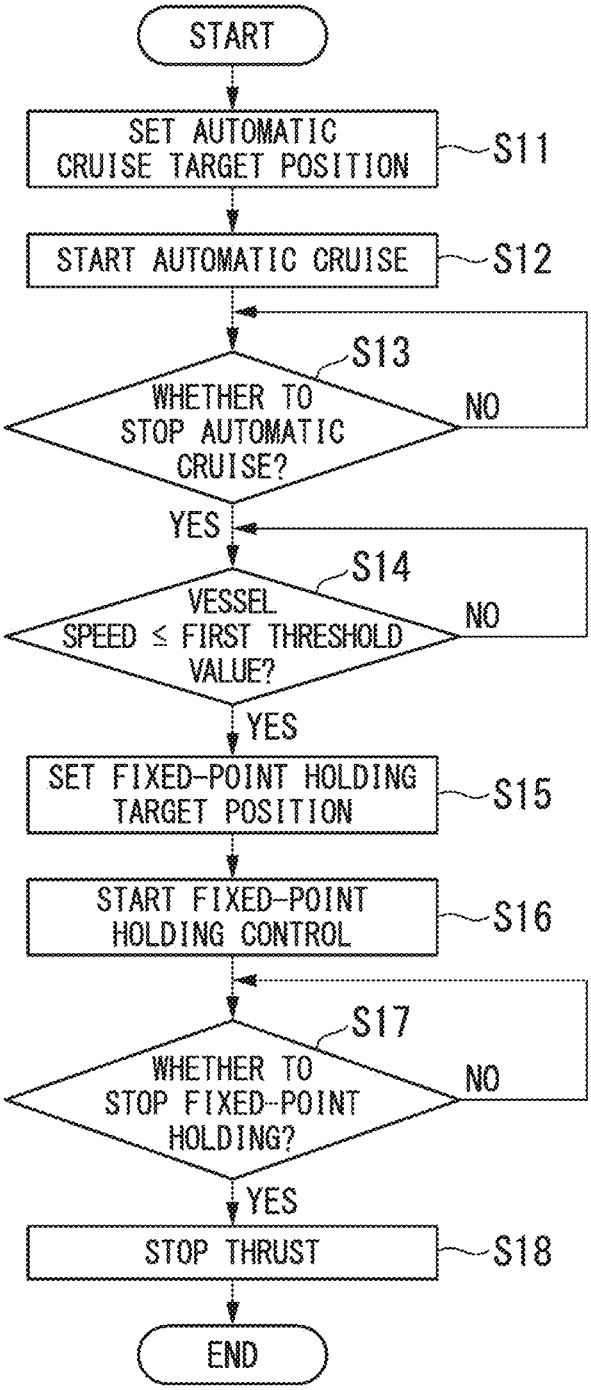
FIG. 3 is a flowchart showing an example of a process performed by a vessel to which the vessel control device of the first embodiment is applied.

In the example shown in FIG. 2B, the position of the vessel 1 determined by the vessel position determination unit 1D approximately matches the automatic cruise target position TP1 (that is, the vessel 1 has reached the automatic cruise target position TP1) and thus the automatic cruise of the vessel 1 is stopped (that is, the vessel control device 1C stops the automatic cruise control of the vessel 1) and the vessel control device 1C causes the actuator 1A to stop generating a propulsive force of the vessel 1. That is, the position of the vessel 1 where the automatic cruise control of the vessel 1 is stopped is the automatic cruise target position TP1.

On the other hand, an inertial force (a tendency to keep moving) of the vessel 1 produced when the vessel 1, which was moving when the automatic cruise control of the vessel 1 was being performed, attempts to stop remains at the time shown in FIG. 2B. Therefore, as shown in FIG. 2C, the vessel 1 continues to move due to the inertial force (tendency to keep moving) of the vessel 1.

Thus, in the example shown in FIG. 2A-FIG. 2D and FIG. 3, in step S14, the vessel control device 1C monitors the speed of the vessel 1. Specifically, in step S14, the vessel control device 1C determines whether the speed of the vessel 1 determined by the vessel speed determination unit 1F has decreased to a first threshold value or less. Step S14 is repeated when the speed of the vessel 1 has not decreased to the first threshold value or less (that is, when the vessel 1 continues to move due to the inertial force (tendency to keep moving) of the vessel 1). On the other hand, the process proceeds to step S15 when the speed of the vessel 1 has decreased to the first threshold value or less (that is, when it can be estimated that the movement of the vessel 1 due to the inertial force (tendency to keep moving) of the vessel 1 has ended).

In step S15, the fixed-point holding target position setting unit 1C2 sets the position of the vessel 1 determined by the vessel position determination unit 1D as a fixed-point holding target position TP2 (see FIG. 2C) which is a target position of the vessel 1 where fixed-point holding control of the vessel 1 is to be performed.

Next, in step S16, the vessel control device 1C starts the fixed-point holding control of the vessel 1.

Next, in step S17, the vessel control device 1C determines whether to stop the fixed-point holding control of the vessel 1. Step S17 is repeated when the vessel control device 1C has determined that the fixed-point holding control of the vessel 1 is not to be stopped (specifically when the fixed-point holding stop instruction input unit 1B6 of the operation unit 1B has not received an input of an instruction to stop the fixed-point holding control of the vessel 1 from the operator of the vessel 1 or the like). On the other hand, the process proceeds to step S18 when the vessel control device 1C has determined that the fixed-point holding control of the vessel 1 is to be stopped (specifically when the fixed-point holding stop instruction input unit 1B6 of the operation unit 1B has received an input of an instruction to stop the fixed-point holding control of the vessel 1 from the operator of the vessel 1 or the like).

In step S18, the vessel control device 1C stops the fixed-point holding control of the vessel 1 and causes the actuator 1A to stop generating a propulsive force of the vessel 1 (specifically a thrust of the vessel 1 for holding the vessel 1 at the fixed-point holding target position TP2 (see FIG. 2D) against disturbances such as wind and current).

That is, in the example shown in FIG. 1 to FIG. 3, when the vessel control device 1C performs automatic cruise control of the vessel 1 and then performs fixed-point holding control of the vessel 1, the fixed-point holding target position setting unit 1C2 sets a position different from the position of the vessel 1 where the automatic cruise control of the vessel 1 is stopped (the automatic cruise target position TP1 in the example shown in FIG. 2A-FIG. 2D) as the fixed-point holding target position TP2 (see FIG. 2C).

Therefore, in the example shown in FIG. 1 to FIG. 3, it is possible to realize a smooth transition from automatic cruise control of the vessel 1 to fixed-point holding control of the vessel 1 while preventing generation of a thrust of the vessel 1 in a direction against the inertial force (tendency to keep moving) of the vessel 1 produced when transitioning from automatic cruise control of the vessel 1 to fixed-point holding control of the vessel 1 (that is, it is possible to make the behavior of the vessel 1 seamless while providing comfort to occupants of the vessel 1), without the need to perform complicated vessel speed control at the final stage of automatic cruise control of the vessel 1 unlike the technology described in Patent Document 1.

In the example shown in FIG. 1 to FIG. 3, when stopping the automatic cruise control of the vessel 1, the vessel control device 1C stops the actuator 1A from generating a propulsive force and thrust of the vessel 1, but in another example, when stopping the automatic cruise control of the vessel 1, the vessel control device 1C may cause the actuator 1A to generate a thrust in a direction against the inertial force of the vessel 1 produced when the automatic cruise control of the vessel 1 is stopped.

In the example shown in FIG. 1 to FIG. 3, the position of the vessel 1 determined by the vessel position determination unit 1D when performing step S15 of FIG. 3 is set as the fixed-point holding target position TP2, but in another example, the position of the vessel 1 where the speed of the vessel 1 becomes zero may be predicted based on the speed of the vessel 1 when performing step S15 of FIG. 3 and the predicted position may be set as the fixed-point holding target position TP2.

Second Embodiment

Hereinafter, a second embodiment of a vessel, a vessel control device, a vessel control method, and a program of the present invention will be described.

A vessel 1 of the second embodiment is configured similar to the vessel 1 of the first embodiment described above, except for the points described below. Thus, the vessel 1 of the second embodiment can achieve the same advantages as the vessel 1 of the first embodiment described above, except for those described below.

The vessel 1 to which a vessel control device 1C of the second embodiment is applied is configured similar to the vessel 1 to which the vessel control device 1C of the first embodiment shown in FIG. 1 is applied.

Figure 4:
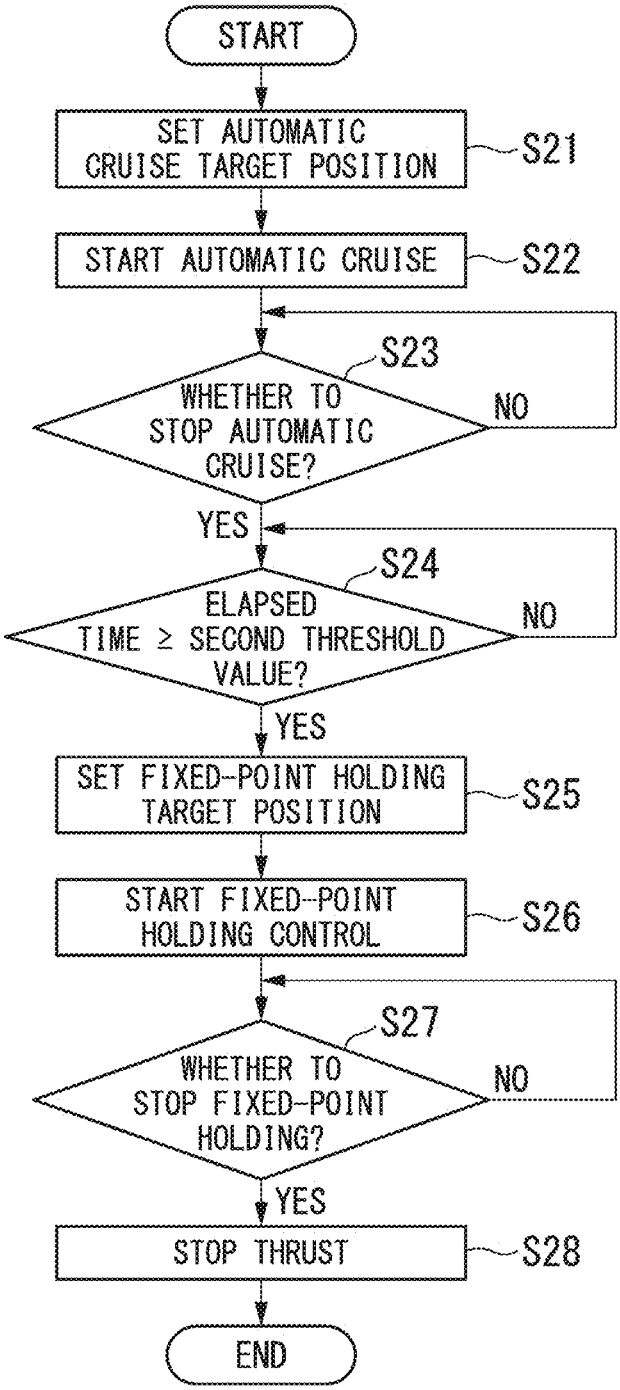
FIG. 4 is a flowchart showing an example of a process performed by a vessel to which a vessel control device of a second embodiment is applied.

FIG. 4 is a flowchart showing an example of a process performed by the vessel 1 to which the vessel control device 1C of the second embodiment is applied.

In the example shown in FIG. 4, in step S21, the automatic cruise target position setting unit 1B3 receives a setting of an automatic cruise target position TP1 (see FIG. 2B), which is a target position of automatic cruise control of the vessel 1, for example, from the operator of the vessel 1 or the like, similar to step S11 of FIG. 3.

Next, in step S22, the automatic cruise start instruction input unit 1B4 receives an input of an instruction to start automatic cruise control of the vessel 1, for example, from the operator of the vessel 1 or the like, similar to step S12 of FIG. 3. As a result, the vessel control device 1C starts automatic cruise control of the vessel 1 (that is, the vessel 1 starts automatic cruise), and as shown in FIG. 2A, the vessel 1 moves toward the automatic cruise target position TP1.

Next, in step S23, the vessel control device 1C determines whether to stop the automatic cruise control of the vessel 1, similar to step S13 of FIG. 3. Step S23 is repeated when the vessel control device 1C has determined that the automatic cruise control of the vessel 1 is not to be stopped. On the other hand, the process proceeds to step S24 when the vessel control device 1C has determined that the automatic cruise control of the vessel 1 is to be stopped.

In the example shown in FIG. 2B, the position of the vessel 1 determined by the vessel position determination unit 1D approximately matches the automatic cruise target position TP1 and thus the automatic cruise of the vessel 1 is stopped and the vessel control device 1C causes the actuator 1A to stop generating a propulsive force of the vessel 1 as described above. That is, the position of the vessel 1 where the automatic cruise control of the vessel 1 is stopped is the automatic cruise target position TP1.

Also, an inertial force (a tendency to keep moving) of the vessel 1 produced when the vessel 1, which was moving when the automatic cruise control of the vessel 1 was being performed, attempts to stop remains at the time shown in FIG. 2B as described above. Therefore, as shown in FIG. 2C, the vessel 1 continues to move due to the inertial force (tendency to keep moving) of the vessel 1.

Thus, in the example shown in FIG. 2A-FIG. 2D and FIG. 4, in step S24, the vessel control device 1C monitors the elapsed time since the automatic cruise control of the vessel 1 was stopped. Specifically, in step S24, the vessel control device 1C determines whether the elapsed time since the automatic cruise control of the vessel 1 was stopped is equal to or greater than a second threshold value. Step S24 is repeated when the elapsed time is not equal to or greater than the second threshold value (that is, when it can be estimated that the vessel 1 continues to move due to the inertial force (tendency to keep moving) of the vessel 1). On the other hand, the process proceeds to step S25 when the elapsed time is equal to or greater than the second threshold value (that is, when it can be estimated that the movement of the vessel 1 due to the inertial force (tendency to keep moving) of the vessel 1 has ended).

In step S25, the fixed-point holding target position setting unit 1C2 sets the position of the vessel 1 determined by the vessel position determination unit 1D as a fixed-point holding target position TP2 (see FIG. 2C) which is a target position of the vessel 1 where fixed-point holding control of the vessel 1 is to be performed, similar to step S15 of FIG. 3.

Next, in step S26, the vessel control device 1C starts the fixed-point holding control of the vessel 1, similar to step S16 of FIG. 3.

Next, in step S27, the vessel control device 1C determines whether to stop the fixed-point holding control of the vessel 1, similar to step S17 of FIG. 3. Step S27 is repeated when the vessel control device 1C has determined that the fixed-point holding control of the vessel 1 is not to be stopped. On the other hand, the process proceeds to step S28 when the vessel control device 1C has determined that the fixed-point holding control of the vessel 1 is to be stopped.

In step S28, the vessel control device 1C stops the fixed-point holding control of the vessel 1 and causes the actuator 1A to stop generating a thrust of the vessel 1, similar to step S18 of FIG. 3.

That is, in the example shown in FIG. 2A-FIG. 2D and FIG. 4, when the vessel control device 1C performs automatic cruise control of the vessel 1 and then performs fixed-point holding control of the vessel 1, the fixed-point holding target position setting unit 1C2 sets a position different from the position of the vessel 1 where the automatic cruise control of the vessel 1 is stopped (the automatic cruise target position TP1 in the example shown in FIG. 2A-FIG. 2D) as the fixed-point holding target position TP2.

Therefore, in the example shown in FIG. 2A-FIG. 2D and FIG. 4, it is possible to realize a smooth transition from automatic cruise control of the vessel 1 to fixed-point holding control of the vessel 1 while preventing generation of a thrust of the vessel 1 in a direction against the inertial force (tendency to keep moving) of the vessel 1 produced when transitioning from automatic cruise control of the vessel 1 to fixed-point holding control of the vessel 1 (that is, it is possible to make the behavior of the vessel 1 seamless while providing comfort to occupants of the vessel 1), without the need to perform complicated vessel speed control at the final stage of automatic cruise control of the vessel 1 unlike the technology described in Patent Document 1.

In the example shown in FIG. 2A-FIG. 2D and FIG. 4, when stopping the automatic cruise control of the vessel 1, the vessel control device 1C stops the actuator 1A from generating a propulsive force and thrust of the vessel 1, but in another example, when stopping the automatic cruise control of the vessel 1, the vessel control device 1C may cause the actuator 1A to generate a thrust in a direction against the inertial force of the vessel 1 produced when the automatic cruise control of the vessel 1 is stopped.

Third Embodiment

Hereinafter, a third embodiment of a vessel, a vessel control device, a vessel control method, and a program of the present invention will be described.

A vessel 1 of the third embodiment is configured similar to the vessel 1 of the first embodiment described above, except for the points described below. Thus, the vessel 1 of the third embodiment can achieve the same advantages as the vessel 1 of the first embodiment described above, except for those described below.

The vessel 1 to which a vessel control device 1C of the third embodiment is applied is configured similar to the vessel 1 to which the vessel control device 1C of the first embodiment shown in FIG. 1 is applied.

FIG. 5A-FIG. 5E are diagrams showing an example of the behavior of the vessel 1 when the vessel control device 1C of the third embodiment performs automatic cruise control and then performs fixed-point holding control.

A process similar to the process shown in FIG. 3 is performed for the vessel 1 to which the vessel control device 1C of the third embodiment is applied.

Figures 5A, 5B, 5C, 5D, 5E:
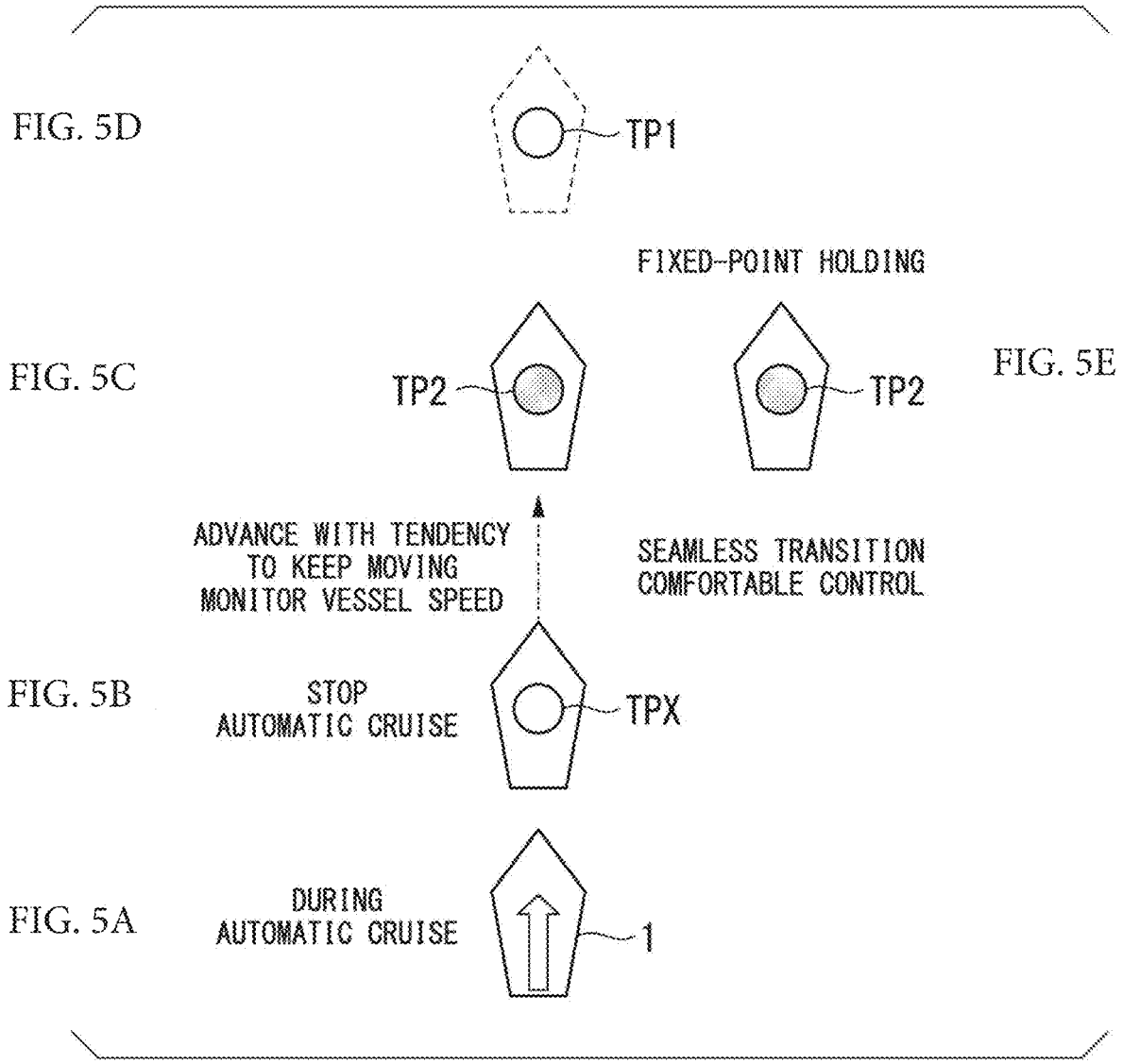
FIG. 5A-FIG. 5E are diagrams showing an example of the behavior of a vessel when a vessel control device of a third embodiment performs automatic cruise control and then performs fixed-point holding control.

In the example shown in FIG. 3 and FIG. 5, in step S11 of FIG. 3, the automatic cruise target position setting unit 1B3 receives a setting of an automatic cruise target position TP1 (see FIG. 5D), which is a target position of automatic cruise control of the vessel 1, for example, from the operator of the vessel 1 or the like.

Next, in step S12, the automatic cruise start instruction input unit 1B4 receives an input of an instruction to start automatic cruise control of the vessel 1, for example, from the operator of the vessel 1 or the like. As a result, the vessel control device 1C starts automatic cruise control of the vessel 1 (that is, the vessel 1 starts automatic cruise), and as shown in FIG. 5A, the vessel 1 moves toward the automatic cruise target position TP1.

Next, in step S13, the vessel control device 1C determines whether to stop the automatic cruise control of the vessel 1. Step S13 is repeated when the vessel control device 1C has determined that the automatic cruise control of the vessel 1 is not to be stopped (specifically when the position of the vessel 1 determined by the vessel position determination unit 1D does not approximately match the automatic cruise target position TP1 (that is, the vessel 1 has not reached the automatic cruise target position TP1) and the automatic cruise stop instruction input unit 1B5 has not received an input of an instruction to stop the automatic cruise control of the vessel 1 from the operator of the vessel 1 or the like). On the other hand, the process proceeds to step S14 when the vessel control device 1C has determined that the automatic cruise control of the vessel 1 is to be stopped (specifically when the position of the vessel 1 determined by the vessel position determination unit 1D approximately matches the automatic cruise target position TP1 (that is, the vessel 1 has reached the automatic cruise target position TP1) or when the automatic cruise stop instruction input unit 1B5 has received an input of an instruction to stop the automatic cruise control of the vessel 1 from the operator of the vessel 1 or the like).

In the example shown in FIG. 5B, the automatic cruise stop instruction input unit 1B5 receives an input of an instruction to stop the automatic cruise control of the vessel 1 from the operator of the vessel 1 or the like before the vessel 1 reaches the automatic cruise target position TP1 and thus the automatic cruise of the vessel 1 is stopped (that is, the vessel control device 1C stops the automatic cruise control of the vessel 1) and the vessel control device 1C causes the actuator 1A to stop generating a propulsive force of the vessel 1.

On the other hand, an inertial force (a tendency to keep moving) of the vessel 1 produced when the vessel 1, which was moving when the automatic cruise control of the vessel 1 was being performed, attempts to stop remains at the time shown in FIG. 5B. Therefore, as shown in FIG. 5C, the vessel 1 continues to move due to the inertial force (tendency to keep moving) of the vessel 1.

Thus, in the example shown in FIG. 3 and FIG. 5, in step S14, the vessel control device 1C monitors the speed of the vessel 1. Specifically, in step S14, the vessel control device 1C determines whether the speed of the vessel 1 determined by the vessel speed determination unit 1F has decreased to a first threshold value or less. Step S14 is repeated when the speed of the vessel 1 has not decreased to the first threshold value or less (that is, when the vessel 1 continues to move due to the inertial force (tendency to keep moving) of the vessel 1). On the other hand, the process proceeds to step S15 when the speed of the vessel 1 has decreased to the first threshold value or less (that is, when it can be estimated that the movement of the vessel 1 due to the inertial force (tendency to keep moving) of the vessel 1 has ended).

In step S15, the fixed-point holding target position setting unit 1C2 sets the position of the vessel 1 determined by the vessel position determination unit 1D as a fixed-point holding target position TP2 (see FIG. 5C) which is a target position of the vessel 1 where fixed-point holding control of the vessel 1 is to be performed.

Next, in step S16, the vessel control device 1C starts the fixed-point holding control of the vessel 1.

Next, in step S17, the vessel control device 1C determines whether to stop the fixed-point holding control of the vessel 1. Step S17 is repeated when the vessel control device 1C has determined that the fixed-point holding control of the vessel 1 is not to be stopped (specifically when the fixed-point holding stop instruction input unit 1B6 of the operation unit 1B has not received an input of an instruction to stop the fixed-point holding control of the vessel 1 from the operator of the vessel 1 or the like). On the other hand, the process proceeds to step S18 when the vessel control device 1C has determined that the fixed-point holding control of the vessel 1 is to be stopped (specifically when the fixed-point holding stop instruction input unit 1B6 of the operation unit 1B has received an input of an instruction to stop the fixed-point holding control of the vessel 1 from the operator of the vessel 1 or the like).

In step S18, the vessel control device 1C stops the fixed-point holding control of the vessel 1 and causes the actuator 1A to stop generating a propulsive force of the vessel 1 (specifically a thrust of the vessel 1 for holding the vessel 1 at the fixed-point holding target position TP2 (see FIG. 5E) against disturbances such as wind and current).

That is, in the example shown in FIG. 3 and FIG. 5, when the vessel control device 1C performs automatic cruise control of the vessel 1 and then performs fixed-point holding control of the vessel 1, the fixed-point holding target position setting unit 1C2 sets a position different from the position TPX of the vessel 1 where the automatic cruise control of the vessel 1 is stopped (see FIG. 5B) as the fixed-point holding target position TP2 (see FIG. 5C). Specifically, the fixed-point holding target position setting unit 1C2 sets a position different from the position TPX of the vessel 1 determined by the vessel position determination unit 1D at the time when the automatic cruise stop instruction input unit 1B5 receives an input of an instruction to stop the automatic cruise control of the vessel 1 from the operator of the vessel 1 or the like as the fixed-point holding target position TP2.

Therefore, in the example shown in FIG. 3 and FIG. 5, it is possible to realize a smooth transition from automatic cruise control of the vessel 1 to fixed-point holding control of the vessel 1 while preventing generation of a thrust of the vessel 1 in a direction against the inertial force (tendency to keep moving) of the vessel 1 produced when transitioning from automatic cruise control of the vessel 1 to fixed-point holding control of the vessel 1 (that is, it is possible to make the behavior of the vessel 1 seamless while providing comfort to occupants of the vessel 1), without the need to perform complicated vessel speed control at the final stage of automatic cruise control of the vessel 1 unlike the technology described in Patent Document 1.

In the example shown in FIG. 3 and FIG. 5, when stopping the automatic cruise control of the vessel 1, the vessel control device 1C stops the actuator 1A from generating a propulsive force and thrust of the vessel 1, but in another example, when stopping the automatic cruise control of the vessel 1, the vessel control device 1C may cause the actuator 1A to generate a thrust in a direction against the inertial force of the vessel 1 produced when the automatic cruise control of the vessel 1 is stopped.

Fourth Embodiment

Hereinafter, a fourth embodiment of a vessel, a vessel control device, a vessel control method, and a program of the present invention will be described.

A vessel 1 of the fourth embodiment is configured similar to the vessel 1 of the first and third embodiments described above, except for the points described below. Thus, the vessel 1 of the fourth embodiment can achieve the same advantages as the vessel 1 of the first and third embodiments described above, except for those described below.

The vessel 1 to which a vessel control device 1C of the fourth embodiment is applied is configured similar to the vessel 1 to which the vessel control device 1C of the first embodiment shown in FIG. 1 is applied.

A process similar to the process shown in FIG. 4 is performed for the vessel 1 to which the vessel control device 1C of the fourth embodiment is applied.

In an example of the vessel 1 to which the vessel control device 1C of the fourth embodiment is applied, in step S21 of FIG. 4, the automatic cruise target position setting unit 1B3 receives a setting of an automatic cruise target position TP1 (see FIG. 5D), which is a target position of automatic cruise control of the vessel 1, for example, from the operator of the vessel 1 or the like.

Next, in step S22 of FIG. 4, the automatic cruise start instruction input unit 1B4 receives an input of an instruction to start automatic cruise control of the vessel 1, for example, from the operator of the vessel 1 or the like. As a result, the vessel control device 1C starts automatic cruise control of the vessel 1 (that is, the vessel 1 starts automatic cruise), and as shown in FIG. 5A, the vessel 1 moves toward the automatic cruise target position TP1.

Next, in step S23 of FIG. 4, the vessel control device 1C determines whether to stop the automatic cruise control of the vessel 1. Step S23 is repeated when the vessel control device 1C has determined that the automatic cruise control of the vessel 1 is not to be stopped. On the other hand, the process proceeds to step S24 when the vessel control device 1C has determined that the automatic cruise control of the vessel 1 is to be stopped.

In the example shown in FIG. 5B, the automatic cruise stop instruction input unit 1B5 receives an input of an instruction to stop the automatic cruise control of the vessel 1 from the operator of the vessel 1 or the like before the vessel 1 reaches the automatic cruise target position TP1 and thus the automatic cruise of the vessel 1 is stopped (that is, the vessel control device 1C stops the automatic cruise control of the vessel 1) and the vessel control device 1C causes the actuator 1A to stop generating a propulsive force of the vessel 1.

On the other hand, an inertial force (a tendency to keep moving) of the vessel 1 produced when the vessel 1, which was moving when the automatic cruise control of the vessel 1 was being performed, attempts to stop remains at the time shown in FIG. 5B. Therefore, as shown in FIG. 5C, the vessel 1 continues to move due to the inertial force (tendency to keep moving) of the vessel 1.

Thus, in an example of the vessel 1 to which the vessel control device 1C of the fourth embodiment is applied, in step S24 of FIG. 4, the vessel control device 1C monitors the elapsed time since the automatic cruise stop instruction input unit 1B5 received an input of an instruction to stop the automatic cruise control of the vessel 1 from the operator of the vessel 1 or the like (the elapsed time since the automatic cruise control was stopped). Specifically, in step S24 of FIG. 4, the vessel control device 1C determines whether the elapsed time since the automatic cruise stop instruction input unit 1B5 received an input of an instruction to stop the automatic cruise control of the vessel 1 from the operator of the vessel 1 or the like is equal to or greater than a second threshold value. Step S24 of FIG. 4 is repeated when the elapsed time is not equal to or greater than the second threshold value (that is, when it can be estimated that the vessel 1 continues to move due to the inertial force (tendency to keep moving) of the vessel 1). On the other hand, the process proceeds to step S25 of FIG. 4 when the elapsed time is equal to or greater than the second threshold value (that is, when it can be estimated that the movement of the vessel 1 due to the inertial force (tendency to keep moving) of the vessel 1 has ended).

In step S25 of FIG. 4, the fixed-point holding target position setting unit 1C2 sets the position of the vessel 1 determined by the vessel position determination unit 1D as a fixed-point holding target position TP2 (see FIG. 5C) which is a target position of the vessel 1 where fixed-point holding control of the vessel 1 is to be performed.

Next, in step S26 of FIG. 4, the vessel control device 1C starts the fixed-point holding control of the vessel 1.

Next, in step S27 of FIG. 4, the vessel control device 1C determines whether to stop the fixed-point holding control of the vessel 1. Step S27 of FIG. 4 is repeated when the vessel control device 1C has determined that the fixed-point holding control of the vessel 1 is not to be stopped. On the other hand, the process proceeds to step S28 of FIG. 4 when the vessel control device 1C has determined that the fixed-point holding control of the vessel 1 is to be stopped.

In step S28 of FIG. 4, the vessel control device 1C stops the fixed-point holding control of the vessel 1 and causes the actuator 1A to stop generating a thrust of the vessel 1.

That is, in an example of the vessel 1 to which the vessel control device 1C of the fourth embodiment is applied, when the vessel control device 1C performs automatic cruise control of the vessel 1 and then performs fixed-point holding control of the vessel 1, the fixed-point holding target position setting unit 1C2 sets a position different from the position TPX of the vessel 1 where the automatic cruise control of the vessel 1 is stopped (see FIG. 5B) as the fixed-point holding target position TP2 (see FIG. 5C). Specifically, the fixed-point holding target position setting unit 1C2 sets a position different from the position TPX of the vessel 1 determined by the vessel position determination unit 1D at the time when the automatic cruise stop instruction input unit 1B5 receives an input of an instruction to stop the automatic cruise control of the vessel 1 from the operator of the vessel 1 or the like as the fixed-point holding target position TP2.

Therefore, in an example of the vessel 1 to which the vessel control device 1C of the fourth embodiment is applied, it is possible to realize a smooth transition from automatic cruise control of the vessel 1 to fixed-point holding control of the vessel 1 while preventing generation of a thrust of the vessel 1 in a direction against the inertial force (tendency to keep moving) of the vessel 1 produced when transitioning from automatic cruise control of the vessel 1 to fixed-point holding control of the vessel 1 (that is, it is possible to make the behavior of the vessel 1 seamless while providing comfort to occupants of the vessel 1), without the need to perform complicated vessel speed control at the final stage of automatic cruise control of the vessel 1 unlike the technology described in Patent Document 1.

In an example of the vessel 1 to which the vessel control device 1C of the fourth embodiment is applied, when stopping the automatic cruise control of the vessel 1, the vessel control device 1C stops the actuator 1A from generating a propulsive force and thrust of the vessel 1, but in another example, when stopping the automatic cruise control of the vessel 1, the vessel control device 1C may cause the actuator 1A to generate a thrust in a direction against the inertial force of the vessel 1 produced when the automatic cruise control of the vessel 1 is stopped.

Fifth Embodiment

Hereinafter, a fifth embodiment of a vessel, a vessel control device, a vessel control method, and a program of the present invention will be described.

A vessel 1 of the fifth embodiment is configured similar to the vessel 1 of the first embodiment described above, except for the points described below. Thus, the vessel 1 of the fifth embodiment can achieve the same advantages as the vessel 1 of the first embodiment described above, except for those described below.

Figure 6:
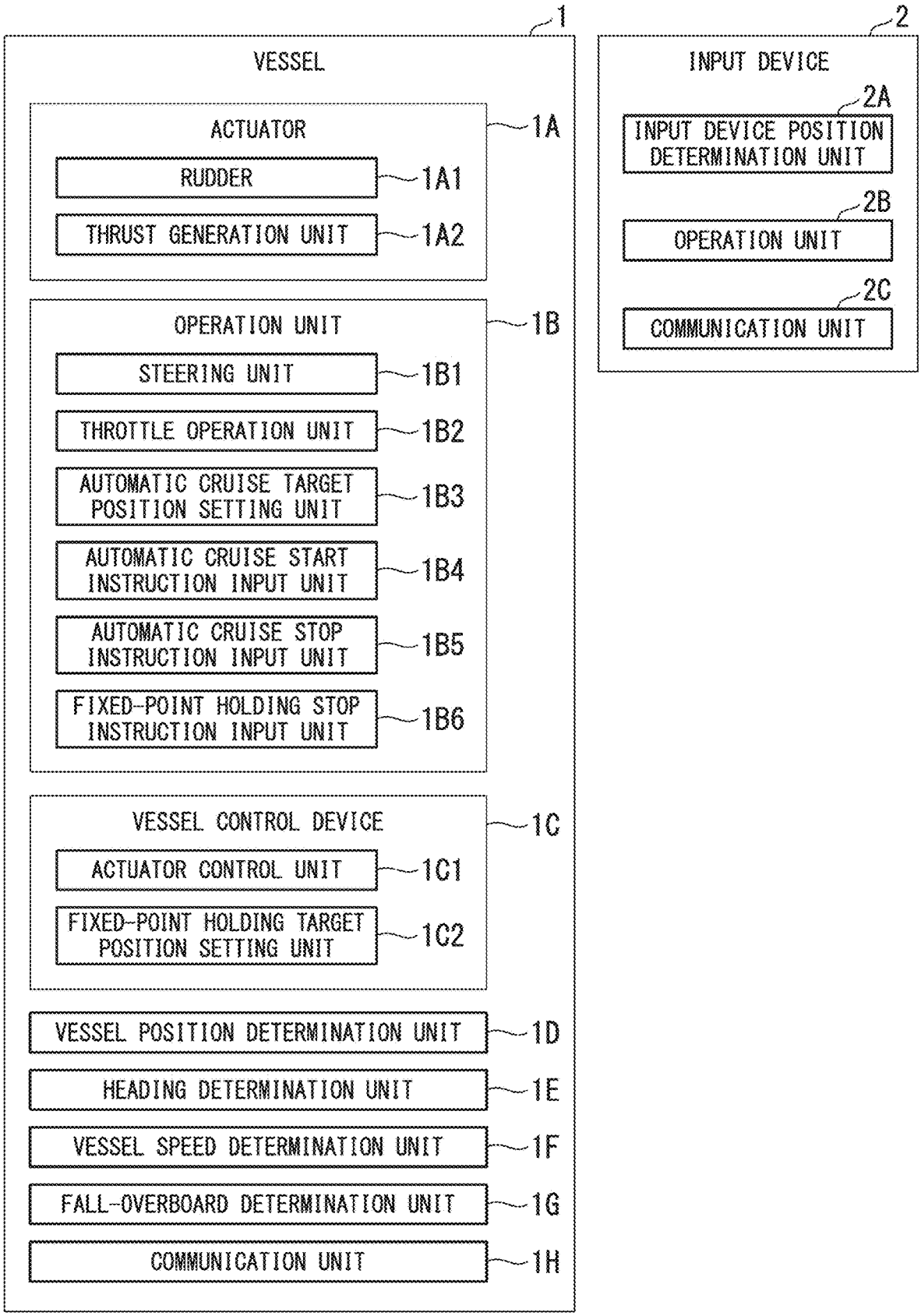
FIG. 6 is a diagram showing an example of a vessel or the like to which a vessel control device of a fifth embodiment is applied.

FIG. 6 is a diagram showing an example of a vessel 1 or the like to which a vessel control device 1C of the fifth embodiment is applied.

In the example shown in FIG. 6, the vessel 1 includes an actuator 1A, an operation unit 1B, a vessel control device 1C, a vessel position determination unit 1D, a heading determination unit 1E, a vessel speed determination unit 1F, a fall-overboard determination unit 1G, and a communication unit 1H.

The actuator 1A is configured similar to the actuator 1A shown in FIG. 1. The operation unit 1B is configured similar to the operation unit 1B shown in FIG. 1. The vessel control device 1C is configured similar to the vessel control device 1C shown in FIG. 1. The vessel position determination unit 1D is configured similar to the vessel position determination unit 1D shown in FIG. 1. The heading determination unit 1E is configured similar to the heading determination unit 1E shown in FIG. 1. The vessel speed determination unit 1F is configured similar to the vessel speed determination unit 1F shown in FIG. 1.

The fall-overboard determination unit 1G determines a fall-overboard of an occupant of the vessel 1 (such as, for example, an operator of the vessel 1). The fall-overboard determination unit 1G is configured similar to, for example, a lanyard cord and a switch described in paragraph 0002 of Japanese Patent No. 4205261. Specifically, one end of a lanyard cord is connected to a person whose fall-overboard is to be determined (for example, an occupant of the vessel 1 such as the operator of the vessel 1). The other end of the lanyard cord is connected to a switch (not shown) located in the vessel 1.

When the person to be determined falls overboard from the vessel 1, the other end of the lanyard cord is disconnected from the switch and the switch determines the fall-overboard of the person to be determined. As a result, the vessel control device 1C switches from a mode in which it performs control for operating the actuator 1A based on an input operation that the operation unit 1B receives from the operator of the vessel 1 to a mode in which it performs automatic cruise control of the vessel 1.

The communication unit 1H communicates with an input device 2 carried by the person whose fall-overboard is to be determined by the fall-overboard determination unit 1G.

The input device 2 includes an input device position determination unit 2A, an operation unit 2B, and a communication unit 2C. The input device position determination unit 2A determines the position of the input device 2. The input device position determination unit 2A includes, for example, a GPS device. The GPS device calculates the position coordinates of the input device 2 by receiving signals from a plurality of GPS satellites.

The operation unit 2B receives, for example, a request to start automatic cruise control of the vessel 1 (specifically, automatic cruise control of the vessel 1 that brings the vessel 1 closer to the input device 2) from a person to be determined who has fallen overboard from the vessel 1 while carrying the input device 2.

The communication unit 2C transmits information indicating the position of the input device 2 determined by the input device position determination unit 2A to the vessel 1. The communication unit 1H of the vessel 1 receives the information indicating the position of the input device 2 transmitted by the communication unit 2C. The position of the input device 2 determined by the input device position determination unit 2A is used for the automatic cruise control of the vessel 1 by the vessel control device 1C (specifically, used for setting of the automatic cruise target position TP1 (see FIG. 2B) by the vessel control device 1C).

The communication unit 2C also transmits to the vessel 1 the request to start automatic cruise control of the vessel 1 (specifically, automatic cruise control of the vessel 1 that brings the vessel 1 closer to the input device 2) which has been received by the operation unit 2B. The communication unit 1H of the vessel 1 receives the request to start automatic cruise control of the vessel 1 transmitted by the communication unit 2C.

In the example shown in FIG. 6, the distance between the vessel 1 and the input device 2 is calculated based on the position of the vessel 1 determined by the vessel position determination unit 1D and the position of the input device 2 determined by the input device position determination unit 2A and is used for automatic cruise control of the vessel 1 by the vessel control device 1C (specifically, used for setting of the automatic cruise target position TP1 by the vessel control device 1C) as described above.

In another example, the vessel 1 may be equipped with a distance determination unit such as, for example, a camera or a radar and the distance between the vessel 1 and the input device 2 may be determined by the distance determination unit and used for automatic cruise control of the vessel 1 by the vessel control device 1C (specifically, used for setting of the automatic cruise target position TP1 by the vessel control device 1C).

FIG. 7A-FIG. 7E are diagrams showing an example of the behavior of the vessel 1 when the vessel control device 1C of the fifth embodiment performs automatic cruise control and then performs fixed-point holding control.

Figure 7A:
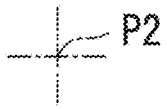
FIG. 7A-FIG. 7E are diagrams showing an example of the behavior of a vessel when the vessel control device of the fifth embodiment performs automatic cruise control and then performs fixed-point holding control.

In the example shown in FIG. 7A-FIG. 7E, a person whose fall-overboard is to be determined by the fall-overboard determination unit 1G (a person to be determined who is carrying the input device 2) falls overboard from a vessel 1 which is moving downward in FIG. 7A-FIG. 7E at a position P2 (see FIG. 7A). As a result, the input device position determination unit 2A of the input device 2 determines the position P2 as the position of the input device 2. The communication unit 2C of the input device 2 transmits information indicating the position P2 of the input device 2 to the vessel 1.

On the other hand, in the vessel 1, the fall-overboard determination unit 1G determines the fall-overboard of the person to be determined and accordingly the mode of the vessel 1 switches to the mode in which the vessel control device 1C performs automatic cruise control of the vessel 1 (specifically, automatic cruise control of the vessel 1 that brings the vessel 1 closer to the input device 2). The vessel position determination unit 1D determines a position P1 (see FIG. 7E) as the position of the vessel 1. The vessel control device 1C sets (calculates) an automatic cruise target position TP1 (see FIG. 7C), which is a target position of automatic cruise control (auto-return control) of the vessel 1, based on the information indicating the position P2 of the input device 2 received by the communication unit 1H and the position P1 of the vessel 1 determined by the vessel position determination unit 1D.

Also, in the example shown in FIG. 7A-FIG. 7E, the operation unit 2B of the input device 2 receives a request to start automatic cruise control of the vessel 1 from the person to be determined who has fallen overboard from the vessel 1 and the communication unit 2C of the input device 2 transmits the request to start automatic cruise control of the vessel 1 to the vessel 1.

Figure 7B:
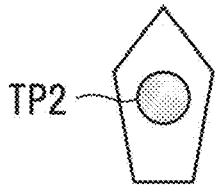
Figure 7C:
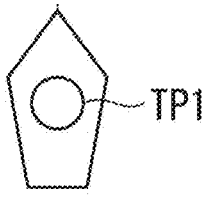
Figure 7D:
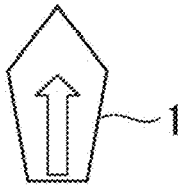

As a result, the vessel control device 1C starts automatic cruise control of the vessel 1 (that is, the vessel 1 starts automatic cruise), and as shown in FIG. 7D, the vessel 1 moves toward the automatic cruise target position TP1.

In another example, when the fall-overboard determination unit 1G has determined a fall-overboard of a person to be determined, the vessel control device 1C may automatically start automatic cruise control of the vessel 1 without the need for the operation unit 2B of the input device 2 to receive a request to start automatic cruise control of the vessel 1 from the person to be determined who has fallen overboard from the vessel 1.

Next, in the example shown in FIG. 7A-FIG. 7E, when the vessel 1 reaches the automatic cruise target position TP1 (see FIG. 7C) (specifically when the position of the vessel 1 determined by the vessel position determination unit 1D approximately matches the automatic cruise target position TP1), the vessel control device 1C stops automatic cruise control of the vessel 1 (specifically, causes the actuator 1A to stop generating a propulsive force of the vessel 1). That is, the position of the vessel 1 where the automatic cruise control of the vessel 1 is stopped is the automatic cruise target position TP1.

On the other hand, an inertial force (a tendency to keep moving) of the vessel 1 produced when the vessel 1, which was moving when the automatic cruise control of the vessel 1 was being performed, attempts to stop remains at the time shown in FIG. 7C. Therefore, as shown in FIG. 7B, the vessel 1 continues to move due to the inertial force (tendency to keep moving) of the vessel 1.

Thus, in the example shown in FIG. 7, the vessel control device 1C monitors the speed of the vessel 1. Specifically, the fixed-point holding target position setting unit 1C2 of the vessel control device 1C sets the position of the vessel 1 determined by the vessel position determination unit 1D when the speed of the vessel 1 determined by the vessel speed determination unit 1F has decreased to a first threshold value or less (that is, when it can be estimated that the movement of the vessel 1 due to the inertial force (tendency to keep moving) of the vessel 1 has ended) as a fixed-point holding target position TP2 (see FIG. 7B) which is a target position of the vessel 1 where fixed-point holding control of the vessel 1 is to be performed. Further, the vessel control device 1C performs fixed-point holding control of the vessel 1.

Figure 8:
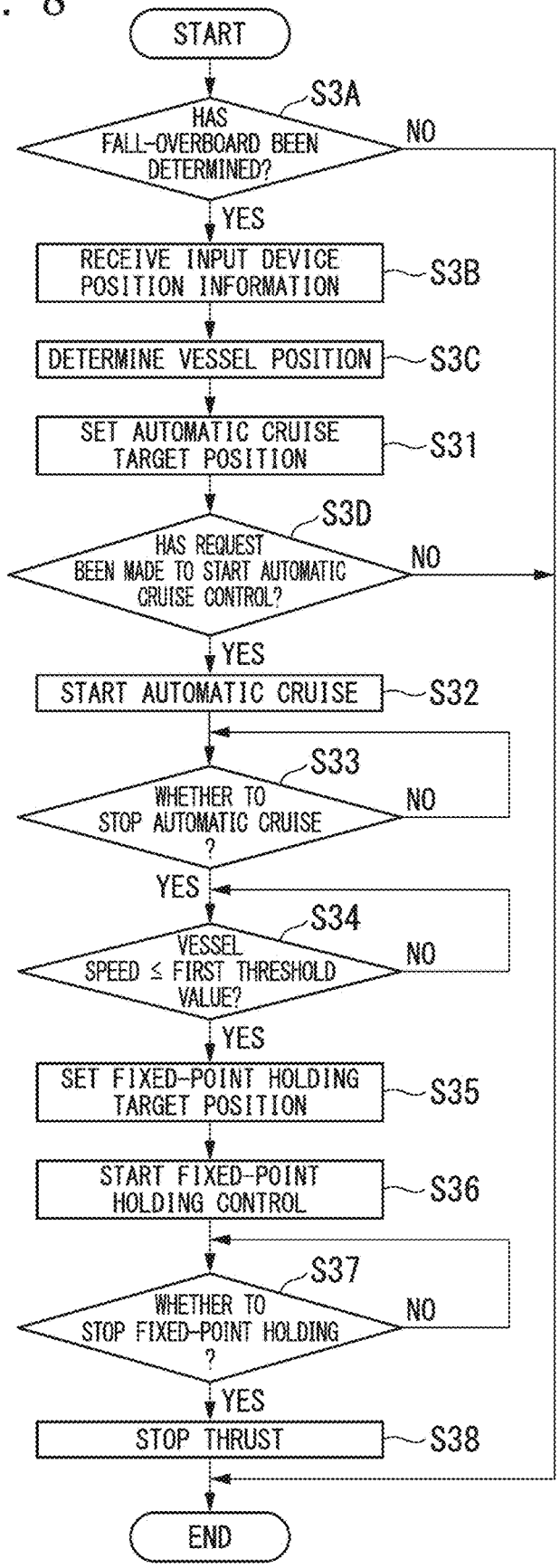
FIG. 8 is a flowchart showing an example of a process performed by a vessel or the like to which the vessel control device of the fifth embodiment is applied.

FIG. 8 is a flowchart showing an example of a process performed by the vessel 1 or the like to which the vessel control device 1C of the fifth embodiment is applied.

In the example shown in FIG. 8, in step S3A, the vessel control device 1C determines whether the fall-overboard determination unit 1G has determined a fall-overboard of the person to be determined. The process proceeds to step S3B when the vessel control device 1C has determined that the fall-overboard determination unit 1G has determined a fall-overboard of the person to be determined. On the other hand, the routine shown in FIG. 8 ends when the vessel control device 1C has determined that the fall-overboard determination unit 1G has not determined a fall-overboard of the person to be determined.

In step S3B, the communication unit 1H receives from the input device 2 information indicating the position P2 of the input device 2 (see FIG. 7A) determined by the input device position determination unit 2A of the input device 2.

Figure 7E:
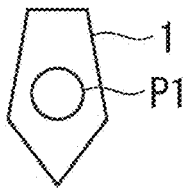

In step S3C, the vessel position determination unit 1D determines the position P1 of the vessel 1 (see FIG. 7E).

Next, in step S31, the vessel control device 1C sets (calculates) an automatic cruise target position TP1 (see FIG. 7C), which is a target position of automatic cruise control (auto-return control) of the vessel 1, based on the information indicating the position P2 of the input device 2 received in step S3B and the position P1 of the vessel 1 determined in step S3C.

In step S3D, the vessel control device 1C determines whether the operation unit 2B of the input device 2 has received a request to start automatic cruise control of the vessel 1 from the person to be determined who has fallen overboard from the vessel 1. Specifically, in step S3D, the vessel control device 1C determines whether the communication unit 1H has received from the input device 2 a request to start automatic cruise control of the vessel 1 that has been made by the person to be determined who has fallen overboard from the vessel 1. The process proceeds to step S32 when the operation unit 2B of the input device 2 has received a request to start automatic cruise control of the vessel 1 from a person to be determined who has fallen overboard from the vessel 1 (that is, when the communication unit 1H has received a request to start automatic cruise control of the vessel 1 from a person to be determined who has fallen overboard from the vessel 1 from the input device 2). On the other hand, the routine shown in FIG. 8 ends when the operation unit 2B of the input device 2 has not received a request to start automatic cruise control of the vessel 1 from the person to be determined who has fallen overboard from the vessel 1 (that is, when the communication unit 1H has not received a request to start automatic cruise control of the vessel 1 from the person to be determined who has fallen overboard from the vessel 1 from the input device 2).

In another example, when it is determined in step S3A that the fall-overboard determination unit 1G has determined a fall-overboard of the person to be determined, the process may proceed to step S32 without the need for the communication unit 1H to receive a request to start automatic cruise control of the vessel 1 from the person to be determined who has fallen overboard from the vessel 1 from the input device 2 as described above.

In the example shown in FIG. 8, in step S32, the vessel control device 1C starts automatic cruise control of the vessel 1 (that is, the vessel 1 starts automatic cruise), and as shown in FIG. 7D, the vessel 1 moves toward the automatic cruise target position TP1.

Next, in step S33, the vessel control device 1C determines whether to stop the automatic cruise control of the vessel 1. Step S33 is repeated when the vessel control device 1C has determined that the automatic cruise control of the vessel 1 is not to be stopped (specifically when the position of the vessel 1 determined by the vessel position determination unit 1D does not approximately match the automatic cruise target position TP1 (see FIG. 7C) (that is, the vessel 1 has not reached the automatic cruise target position TP1) and the operation unit 2B of the input device 2 has not received an input of an instruction to stop the automatic cruise control of the vessel 1 from the person to be determined who has fallen overboard from the vessel 1). On the other hand, the process proceeds to step S34 when the vessel control device 1C has determined that the automatic cruise control of the vessel 1 is to be stopped (specifically when the position of the vessel 1 determined by the vessel position determination unit 1D approximately matches the automatic cruise target position TP1 (that is, the vessel 1 has reached the automatic cruise target position TP1) or when the operation unit 2B of the input device 2 has received an input of an instruction to stop the automatic cruise control of the vessel 1 from the person to be determined who has fallen overboard from the vessel 1).

In step S34, the vessel control device 1C monitors the speed of the vessel 1. Specifically, in step S34, the vessel control device 1C determines whether the speed of the vessel 1 determined by the vessel speed determination unit 1F has decreased to a first threshold value or less. Step S34 is repeated when the speed of the vessel 1 has not decreased to the first threshold value or less (that is, when the vessel 1 continues to move due to the inertial force (tendency to keep moving) of the vessel 1). On the other hand, the process proceeds to step S35 when the speed of the vessel 1 has decreased to the first threshold value or less (that is, when it can be estimated that the movement of the vessel 1 due to the inertial force (tendency to keep moving) of the vessel 1 has ended).

In step S35, the fixed-point holding target position setting unit 1C2 sets the position of the vessel 1 determined by the vessel position determination unit 1D as a fixed-point holding target position TP2 (see FIG. 7B) which is a target position of the vessel 1 where fixed-point holding control of the vessel 1 is to be performed.

Next, in step S36, the vessel control device 1C starts the fixed-point holding control of the vessel 1.

Next, in step S37, the vessel control device 1C determines whether to stop the fixed-point holding control of the vessel 1. Step S37 is repeated when the vessel control device 1C has determined that the fixed-point holding control of the vessel 1 is not to be stopped (specifically when the communication unit 1H has not received from the input device 2 a request to stop the fixed-point holding control of the vessel 1 that has been made by the person to be determined who has fallen overboard from the vessel 1). On the other hand, the process proceeds to step S38 when the vessel control device 1C has determined that the fixed-point holding control of the vessel 1 is to be stopped (specifically when the communication unit 1H has received from the input device 2 a request to stop the fixed-point holding control of the vessel 1 that has been made by the person to be determined who has fallen overboard from the vessel 1).

In step S38, the vessel control device 1C stops the fixed-point holding control of the vessel 1 and causes the actuator 1A to stop generating a thrust of the vessel 1 (specifically a thrust of the vessel 1 for holding the vessel 1 at the fixed-point holding target position TP2 (see FIG. 7B) against disturbances such as wind and current).

That is, in the example shown in FIG. 6 to FIG. 8, when the vessel control device 1C performs automatic cruise control of the vessel 1 and then performs fixed-point holding control of the vessel 1, the fixed-point holding target position setting unit 1C2 sets a position different from the position of the vessel 1 where the automatic cruise control of the vessel 1 is stopped (the automatic cruise target position TP1 in the example shown in FIG. 7A-FIG. 7E) as the fixed-point holding target position TP2 (see FIG. 7B).

Therefore, in the example shown in FIG. 6 to FIG. 8, it is possible to realize a smooth transition from automatic cruise control of the vessel 1 to fixed-point holding control of the vessel 1 while preventing generation of a thrust of the vessel 1 in a direction against the inertial force (tendency to keep moving) of the vessel 1 produced when transitioning from automatic cruise control of the vessel 1 to fixed-point holding control of the vessel 1 (that is, it is possible to make the behavior of the vessel 1 seamless while providing comfort to the person to be determined who has fallen overboard from the vessel 1), without the need to perform complicated vessel speed control at the final stage of automatic cruise control of the vessel 1 unlike the technology described in Patent Document 1.

In the example shown in FIG. 6 to FIG. 8, when stopping the automatic cruise control of the vessel 1, the vessel control device 1C stops the actuator 1A from generating a propulsive force and thrust of the vessel 1, but in another example, when stopping the automatic cruise control of the vessel 1, the vessel control device 1C may cause the actuator 1A to generate a thrust in a direction against the inertial force of the vessel 1 produced when the automatic cruise control of the vessel 1 is stopped.

Sixth Embodiment

Hereinafter, a sixth embodiment of a vessel, a vessel control device, a vessel control method, and a program of the present invention will be described.

A vessel 1 of the sixth embodiment is configured similar to the vessel 1 of the fifth embodiment described above, except for the points described below. Thus, the vessel 1 of the sixth embodiment can achieve the same advantages as the vessel 1 of the fifth embodiment described above, except for those described below.

The vessel 1 or the like to which the vessel control device 1C of the sixth embodiment is applied is configured similar to the vessel 1 or the like to which the vessel control device 1C of the fifth embodiment shown in FIG. 6 is applied.

Figure 9:
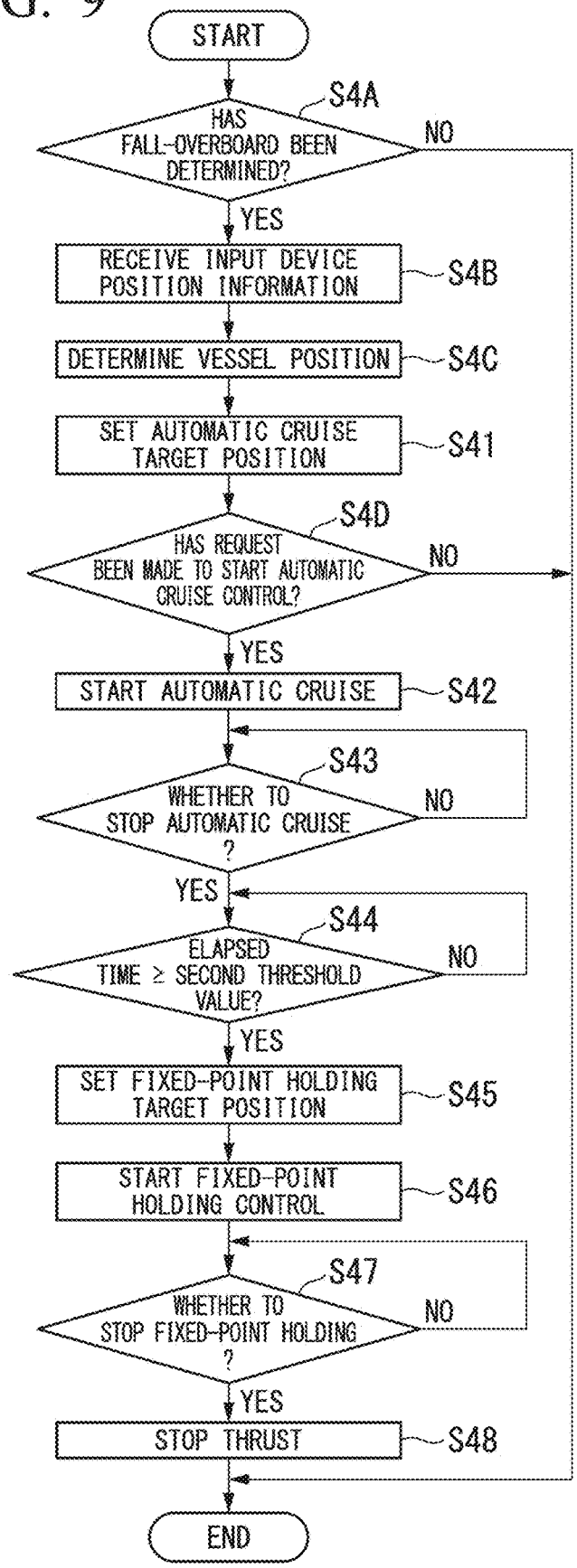
FIG. 9 is a flowchart showing an example of a process performed by a vessel or the like to which a vessel control device of a sixth embodiment is applied.

FIG. 9 is a flowchart showing an example of a process performed by the vessel 1 or the like to which the vessel control device 1C of the sixth embodiment is applied.

In the example shown in FIG. 9, in step S4A, the vessel control device 1C determines whether the fall-overboard determination unit 1G has determined a fall-overboard of the person to be determined, similar to step S3A of FIG. 8. The process proceeds to step S4B when the vessel control device 1C has determined that the fall-overboard determination unit 1G has determined a fall-overboard of the person to be determined. On the other hand, the routine shown in FIG. 9 ends when the vessel control device 1C has determined that the fall-overboard determination unit 1G has not determined a fall-overboard of the person to be determined.

In step S4B, the communication unit 1H receives from the input device 2 information indicating the position P2 of the input device 2 (see FIG. 7A) determined by the input device position determination unit 2A of the input device 2, similar to step S3B of FIG. 8.

In step S4C, the vessel position determination unit 1D determines the position P1 of the vessel 1 (see FIG. 7E), similar to step S3C of FIG. 8.

Next, in step S41, the vessel control device 1C sets (calculates) an automatic cruise target position TP1 (see FIG. 7C), which is a target position of automatic cruise control (auto-return control) of the vessel 1, based on the information indicating the position P2 of the input device 2 received in step S4B and the position P1 of the vessel 1 determined in step S4C, similar to step S31 of FIG. 8.

In step S4D, the vessel control device 1C determines whether the operation unit 2B of the input device 2 has received a request to start automatic cruise control of the vessel 1 from the person to be determined who has fallen overboard from the vessel 1, similar to step S3D of FIG. 8. The process proceeds to step S42 when the operation unit 2B of the input device 2 has received a request to start automatic cruise control of the vessel 1 from a person to be determined who has fallen overboard from the vessel 1. On the other hand, the routine shown in FIG. 9 ends when the operation unit 2B of the input device 2 has not received a request to start automatic cruise control of the vessel 1 from the person to be determined who has fallen overboard from the vessel 1.

In another example, when it is determined in step S4A that the fall-overboard determination unit 1G has determined a fall-overboard of the person to be determined, the process may proceed to step S42 without the need for the communication unit 1H to receive a request to start automatic cruise control of the vessel 1 from the person to be determined who has fallen overboard from the vessel 1 from the input device 2 as described above.

In the example shown in FIG. 9, in step S42, the vessel control device 1C starts automatic cruise control of the vessel 1 (that is, the vessel 1 starts automatic cruise), and as shown in FIG. 7D, the vessel 1 moves toward the automatic cruise target position TP1, similar to step S32 of FIG. 8.

Next, in step S43, the vessel control device 1C determines whether to stop the automatic cruise control of the vessel 1, similar to step S33 of FIG. 8. Step S43 is repeated when the vessel control device 1C has determined that the automatic cruise control of the vessel 1 is not to be stopped (specifically when the position of the vessel 1 determined by the vessel position determination unit 1D does not approximately match the automatic cruise target position TP1 (see FIG. 7C) (that is, the vessel 1 has not reached the automatic cruise target position TP1) and the operation unit 2B of the input device 2 has not received an input of an instruction to stop the automatic cruise control of the vessel 1 from the person to be determined who has fallen overboard from the vessel 1). On the other hand, the process proceeds to step S44 when the vessel control device 1C has determined that the automatic cruise control of the vessel 1 is to be stopped (specifically when the position of the vessel 1 determined by the vessel position determination unit 1D approximately matches the automatic cruise target position TP1 (that is, the vessel 1 has reached the automatic cruise target position TP1) or when the operation unit 2B of the input device 2 has received an input of an instruction to stop the automatic cruise control of the vessel 1 from the person to be determined who has fallen overboard from the vessel 1).

In step S44, the vessel control device 1C monitors the elapsed time since the automatic cruise control of the vessel 1 was stopped. Specifically, in step S44, the vessel control device 1C determines whether the elapsed time since the automatic cruise control of the vessel 1 was stopped is equal to or greater than a second threshold value. Step S44 is repeated when the elapsed time is not equal to or greater than the second threshold value (that is, when it can be estimated that the vessel 1 continues to move due to the inertial force (tendency to keep moving) of the vessel 1). On the other hand, the process proceeds to step S45 when the elapsed time is equal to or greater than the second threshold value (that is, when it can be estimated that the movement of the vessel 1 due to the inertial force (tendency to keep moving) of the vessel 1 has ended).

In step S45, the fixed-point holding target position setting unit 1C2 sets the position of the vessel 1 determined by the vessel position determination unit 1D as a fixed-point holding target position TP2 (see FIG. 7B) which is a target position of the vessel 1 where fixed-point holding control of the vessel 1 is to be performed, similar to step S35 of FIG. 8.

Next, in step S46, the vessel control device 1C starts the fixed-point holding control of the vessel 1, similar to step S36 of FIG. 8.

Next, in step S47, the vessel control device 1C determines whether to stop the fixed-point holding control of the vessel 1, similar to step S37 of FIG. 8. Step S47 is repeated when the vessel control device 1C has determined that the fixed-point holding control of the vessel 1 is not to be stopped. On the other hand, the process proceeds to step S48 when the vessel control device 1C has determined that the fixed-point holding control of the vessel 1 is to be stopped.

In step S48, the vessel control device 1C stops the fixed-point holding control of the vessel 1 and causes the actuator 1A to stop generating a thrust of the vessel 1 (specifically a thrust of the vessel 1 for holding the vessel 1 at the fixed-point holding target position TP2 (see FIG. 7B) against disturbances such as wind and current), similar to step S38 of FIG. 8.

That is, in the example shown in FIG. 6 and FIG. 9, when the vessel control device 1C performs automatic cruise control of the vessel 1 and then performs fixed-point holding control of the vessel 1, the fixed-point holding target position setting unit 1C2 sets a position different from the position of the vessel 1 where the automatic cruise control of the vessel 1 is stopped (the automatic cruise target position TP1 in the example shown in FIG. 7A-FIG. 7E) as the fixed-point holding target position TP2 (see FIG. 7B).

Therefore, in the example shown in FIG. 6 and FIG. 9, it is possible to realize a smooth transition from automatic cruise control of the vessel 1 to fixed-point holding control of the vessel 1 while preventing generation of a thrust of the vessel 1 in a direction against the inertial force (tendency to keep moving) of the vessel 1 produced when transitioning from automatic cruise control of the vessel 1 to fixed-point holding control of the vessel 1 (that is, it is possible to make the behavior of the vessel 1 seamless while providing comfort to the person to be determined who has fallen overboard from the vessel 1), without the need to perform complicated vessel speed control at the final stage of automatic cruise control of the vessel 1 unlike the technology described in Patent Document 1.

In the example shown in FIG. 6 and FIG. 9, when stopping the automatic cruise control of the vessel 1, the vessel control device 1C stops the actuator 1A from generating a propulsive force and thrust of the vessel 1, but in another example, when stopping the automatic cruise control of the vessel 1, the vessel control device 1C may cause the actuator 1A to generate a thrust in a direction against the inertial force of the vessel 1 produced when the automatic cruise control of the vessel 1 is stopped.

Seventh Embodiment

Hereinafter, a seventh embodiment of a vessel, a vessel control device, a vessel control method, and a program of the present invention will be described.

A vessel 1 of the seventh embodiment is configured similar to the vessel 1 of the first embodiment described above, except for the points described below. Thus, the vessel 1 of the seventh embodiment can achieve the same advantages as the vessel 1 of the first embodiment described above, except for those described below.

Figure 10:
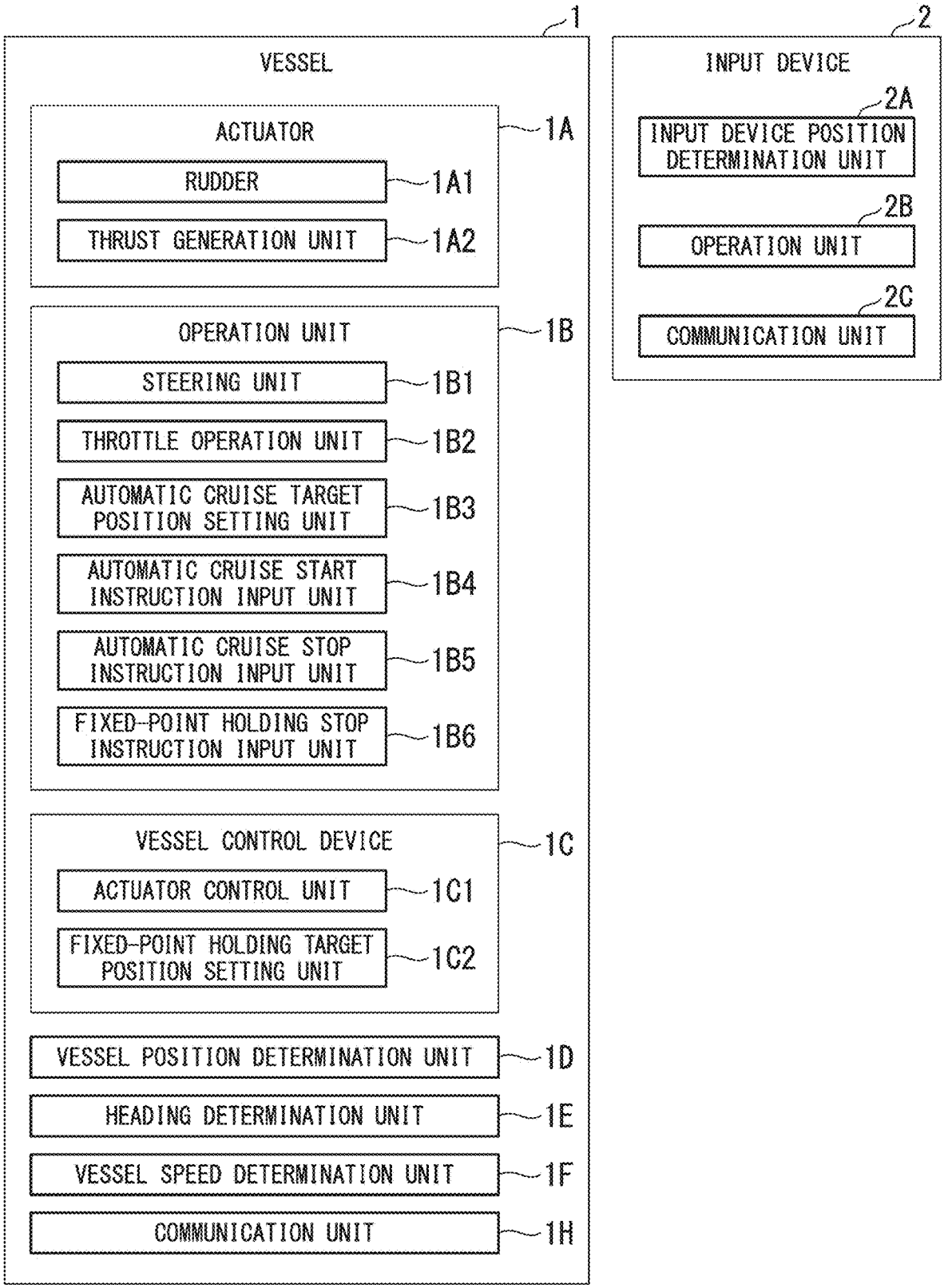
FIG. 10 is a diagram showing an example of a vessel or the like to which a vessel control device of a seventh embodiment is applied.

FIG. 10 is a diagram showing an example of a vessel 1 or the like to which a vessel control device 1C of the seventh embodiment is applied.

In the example shown in FIG. 10, the vessel 1 includes an actuator 1A, an operation unit 1B, a vessel control device 1C, a vessel position determination unit 1D, a heading determination unit 1E, a vessel speed determination unit 1F, and a communication unit 1H.

The actuator 1A is configured similar to the actuator 1A shown in FIG. 1. The operation unit 1B is configured similar to the operation unit 1B shown in FIG. 1. The vessel control device 1C is configured similar to the vessel control device 1C shown in FIG. 1. The vessel position determination unit 1D is configured similar to the vessel position determination unit 1D shown in FIG. 1. The heading determination unit 1E is configured similar to the heading determination unit 1E shown in FIG. 1. The vessel speed determination unit 1F is configured similar to the vessel speed determination unit 1F shown in FIG. 1.

The communication unit 1H communicates with an input device 2 carried by an operator outside the vessel 1 (for example, an operator of the vessel 1 on a pier or the like).

The input device 2 includes an input device position determination unit 2A, an operation unit 2B, and a communication unit 2C. The input device position determination unit 2A determines the position of the input device 2. The input device position determination unit 2A includes, for example, a GPS device. The GPS device calculates the position coordinates of the input device 2 by receiving signals from a plurality of GPS satellites.

The operation unit 2B receives, for example, a request to start automatic cruise control of the vessel 1 (specifically, automatic cruise control of the vessel 1 that brings the vessel 1 closer to the input device 2) from the operator outside the vessel 1 who is carrying the input device 2.

The communication unit 2C transmits information indicating the position of the input device 2 determined by the input device position determination unit 2A to the vessel 1. The communication unit 1H of the vessel 1 receives the information indicating the position of the input device 2 transmitted by the communication unit 2C. The position of the input device 2 determined by the input device position determination unit 2A is used for the automatic cruise control of the vessel 1 by the vessel control device 1C (specifically, used for setting of the automatic cruise target position TP1 (see FIG. 2B) by the vessel control device 1C).

The communication unit 2C also transmits to the vessel 1 the request to start automatic cruise control of the vessel 1 (specifically, automatic cruise control of the vessel 1 that brings the vessel 1 closer to the input device 2) which has been received by the operation unit 2B. The communication unit 1H of the vessel 1 receives the request to start automatic cruise control of the vessel 1 transmitted by the communication unit 2C.

In the example shown in FIG. 10, the distance between the vessel 1 and the input device 2 is calculated based on the position of the vessel 1 determined by the vessel position determination unit 1D and the position of the input device 2 determined by the input device position determination unit 2A and is used for automatic cruise control of the vessel 1 by the vessel control device 1C (specifically, used for setting of the automatic cruise target position TP1 by the vessel control device 1C).

In another example, the vessel 1 may be equipped with a distance determination unit such as, for example, a camera or a radar and the distance between the vessel 1 and the input device 2 may be determined by the distance determination unit and used for automatic cruise control of the vessel 1 by the vessel control device 1C (specifically, used for setting of the automatic cruise target position TP1 by the vessel control device 1C).

Figure 11:
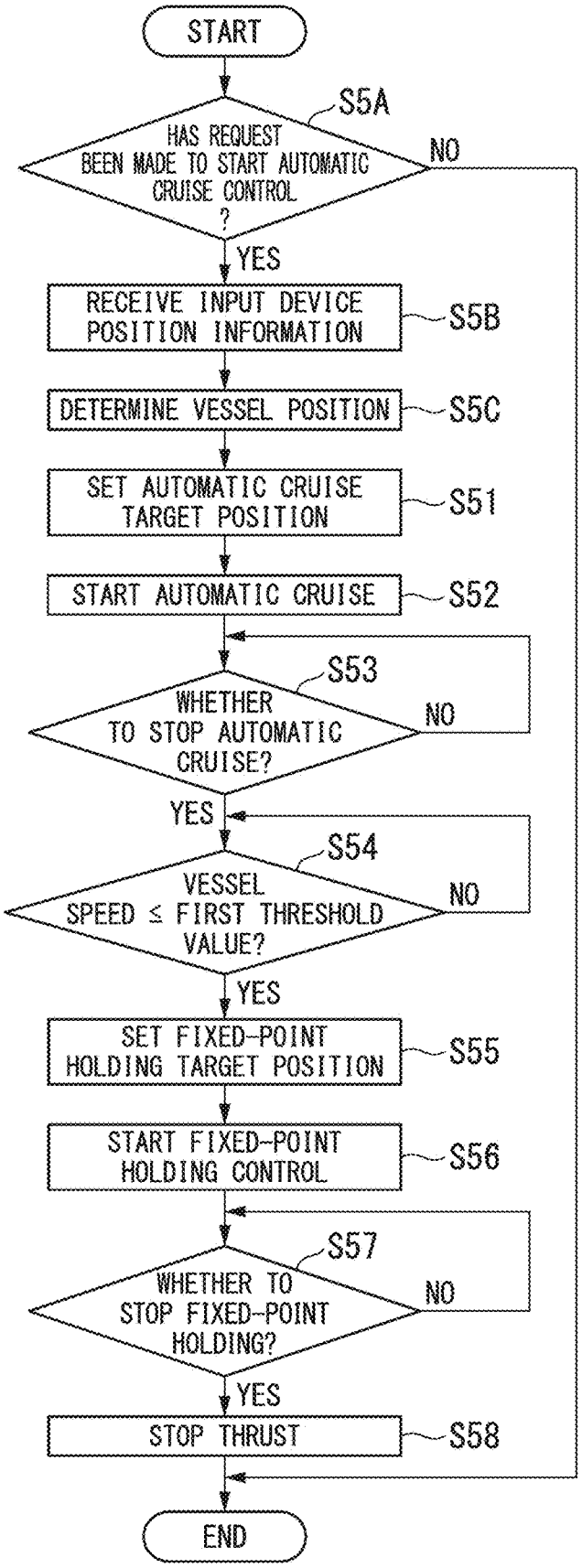
FIG. 11 is a flowchart showing an example of a process performed by a vessel or the like to which the vessel control device of the seventh embodiment is applied.

FIG. 11 is a flowchart showing an example of a process performed by the vessel 1 or the like to which the vessel control device 1C of the seventh embodiment is applied.

In the example shown in FIG. 11, in step S5A, the vessel control device 1C determines whether the operation unit 2B of the input device 2 has received a request to start automatic cruise control of the vessel 1 from the operator outside the vessel 1. The process proceeds to step S5B when the operation unit 2B of the input device 2 has received a request to start automatic cruise control of the vessel 1 from the operator outside the vessel 1 (that is, when the communication unit 1H has received a request to start automatic cruise control of the vessel 1 from the operator outside the vessel 1 from the input device 2). On the other hand, the routine shown in FIG. 11 ends when the operation unit 2B of the input device 2 has not received a request to start automatic cruise control of the vessel 1 from the operator outside the vessel 1 (that is, when the communication unit 1H has not received a request to start automatic cruise control of the vessel 1 from the operator outside the vessel 1 from the input device 2).

In step S5B, the communication unit 1H receives from the input device 2 information indicating the position of the input device 2 determined by the input device position determination unit 2A of the input device 2.

In step S5C, the vessel position determination unit 1D determines the position of the vessel 1.

Next, in step S51, the vessel control device 1C sets (calculates) an automatic cruise target position, which is a target position of automatic cruise control of the vessel 1, based on the information indicating the position of the input device 2 received in step S5B and the position of the vessel 1 determined in step S5C. Next, the process proceeds to step S52.

In step S52, the vessel control device 1C starts automatic cruise control of the vessel 1 (that is, the vessel 1 starts automatic cruise) and the vessel 1 moves toward the automatic cruise target position.

Next, in step S53, the vessel control device 1C determines whether to stop the automatic cruise control of the vessel 1. Step S53 is repeated when the vessel control device 1C has determined that the automatic cruise control of the vessel 1 is not to be stopped (specifically when the position of the vessel 1 determined by the vessel position determination unit 1D does not approximately match the automatic cruise target position (that is, the vessel 1 has not reached the automatic cruise target position) and the operation unit 2B of the input device 2 has not received an input of an instruction to stop the automatic cruise control of the vessel 1 from the operator outside the vessel 1). On the other hand, the process proceeds to step S54 when the vessel control device 1C has determined that the automatic cruise control of the vessel 1 is to be stopped (specifically when the position of the vessel 1 determined by the vessel position determination unit 1D approximately matches the automatic cruise target position (that is, the vessel 1 has reached the automatic cruise target position) or when the operation unit 2B of the input device 2 has received an input of an instruction to stop the automatic cruise control of the vessel 1 from the operator outside the vessel 1).

In step S54, the vessel control device 1C monitors the speed of the vessel 1. Specifically, in step S54, the vessel control device 1C determines whether the speed of the vessel 1 determined by the vessel speed determination unit 1F has decreased to a first threshold value or less. Step S54 is repeated when the speed of the vessel 1 has not decreased to the first threshold value or less (that is, when the vessel 1 continues to move due to the inertial force (tendency to keep moving) of the vessel 1). On the other hand, the process proceeds to step S55 when the speed of the vessel 1 has decreased to the first threshold value or less (that is, when it can be estimated that the movement of the vessel 1 due to the inertial force (tendency to keep moving) of the vessel 1 has ended).

In step S55, the fixed-point holding target position setting unit 1C2 sets the position of the vessel 1 determined by the vessel position determination unit 1D as a fixed-point holding target position which is a target position of the vessel 1 where fixed-point holding control of the vessel 1 is to be performed.

Next, in step S56, the vessel control device 1C starts the fixed-point holding control of the vessel 1.

Next, in step S57, the vessel control device 1C determines whether to stop the fixed-point holding control of the vessel 1. Step S57 is repeated when the vessel control device 1C has determined that the fixed-point holding control of the vessel 1 is not to be stopped (specifically when the communication unit 1H has not received from the input device 2 a request to stop the fixed-point holding control of the vessel 1 that has been made by the operator outside the vessel 1). On the other hand, the process proceeds to step S58 when the vessel control device 1C has determined that the fixed-point holding control of the vessel 1 is to be stopped (specifically when the communication unit 1H has received from the input device 2 a request to stop the fixed-point holding control of the vessel 1 that has been made by the operator outside the vessel 1).

In step S58, the vessel control device 1C stops the fixed-point holding control of the vessel 1 and causes the actuator 1A to stop generating a thrust of the vessel 1 (specifically a thrust of the vessel 1 for holding the vessel 1 at the fixed-point holding target position against disturbances such as wind and current).

That is, in the example shown in FIG. 10 and FIG. 11, when the vessel control device 1C performs automatic cruise control of the vessel 1 and then performs fixed-point holding control of the vessel 1, the fixed-point holding target position setting unit 1C2 sets a position different from the position of the vessel 1 where the automatic cruise control of the vessel 1 is stopped as the fixed-point holding target position.

Therefore, in the example shown in FIG. 10 and FIG. 11, it is possible to realize a smooth transition from automatic cruise control of the vessel 1 to fixed-point holding control of the vessel 1 while preventing generation of a thrust of the vessel 1 in a direction against the inertial force (tendency to keep moving) of the vessel 1 produced when transitioning from automatic cruise control of the vessel 1 to fixed-point holding control of the vessel 1 (that is, it is possible to make the behavior of the vessel 1 seamless), without the need to perform complicated vessel speed control at the final stage of automatic cruise control of the vessel 1 unlike the technology described in Patent Document 1.

In the example shown in FIG. 10 and FIG. 11, when stopping the automatic cruise control of the vessel 1, the vessel control device 1C stops the actuator 1A from generating a propulsive force and thrust of the vessel 1, but in another example, when stopping the automatic cruise control of the vessel 1, the vessel control device 1C may cause the actuator 1A to generate a thrust in a direction against the inertial force of the vessel 1 produced when the automatic cruise control of the vessel 1 is stopped.

In another example of a process performed by the vessel 1 or the like to which the vessel control device 1C of the seventh embodiment is applied, the same process as the process shown in FIG. 3 described above is performed.

Specifically, in step S11 of FIG. 3, the operation unit 2B of the input device 2 receives a setting of an automatic cruise target position TP1 (see FIG. 2B), which is a target position of automatic cruise control of the vessel 1, from the operator outside the vessel 1. The communication unit 2C of the input device 2 transmits information indicating the automatic cruise target position TP1 to the vessel 1.

Next, in step S12, the operation unit 2B of the input device 2 receives an input of an instruction to start automatic cruise control of the vessel 1 from the operator outside the vessel 1. The communication unit 2C of the input device 2 transmits the instruction to start automatic cruise control of the vessel 1 to the vessel 1. As a result, the vessel control device 1C starts automatic cruise control of the vessel 1 (that is, the vessel 1 starts automatic cruise), and as shown in FIG. 2A, the vessel 1 moves toward the automatic cruise target position TP1.

Next, in step S13, the vessel control device 1C determines whether to stop the automatic cruise control of the vessel 1. Step S13 is repeated when the vessel control device 1C has determined that the automatic cruise control of the vessel 1 is not to be stopped (specifically when the position of the vessel 1 determined by the vessel position determination unit 1D does not approximately match the automatic cruise target position TP1 (that is, the vessel 1 has not reached the automatic cruise target position TP1) and the operation unit 2B of the input device 2 has not received an input of an instruction to stop the automatic cruise control of the vessel 1 from the operator outside the vessel 1). On the other hand, the process proceeds to step S14 when the vessel control device 1C has determined that the automatic cruise control of the vessel 1 is to be stopped (specifically when the position of the vessel 1 determined by the vessel position determination unit 1D approximately matches the automatic cruise target position TP1 (that is, the vessel 1 has reached the automatic cruise target position TP1) or when the operation unit 2B of the input device 2 has received an input of an instruction to stop the automatic cruise control of the vessel 1 from the operator outside the vessel 1).

In step S14, the vessel control device 1C monitors the speed of the vessel 1. Specifically, in step S14, the vessel control device 1C determines whether the speed of the vessel 1 determined by the vessel speed determination unit 1F has decreased to a first threshold value or less. Step S14 is repeated when the speed of the vessel 1 has not decreased to the first threshold value or less (that is, when the vessel 1 continues to move due to the inertial force (tendency to keep moving) of the vessel 1). On the other hand, the process proceeds to step S15 when the speed of the vessel 1 has decreased to the first threshold value or less (that is, when it can be estimated that the movement of the vessel 1 due to the inertial force (tendency to keep moving) of the vessel 1 has ended).

In step S15, the fixed-point holding target position setting unit 1C2 sets the position of the vessel 1 determined by the vessel position determination unit 1D as a fixed-point holding target position TP2 (see FIG. 2C) which is a target position of the vessel 1 where fixed-point holding control of the vessel 1 is to be performed.

Next, in step S16, the vessel control device 1C starts the fixed-point holding control of the vessel 1.

Next, in step S17, the vessel control device 1C determines whether to stop the fixed-point holding control of the vessel 1. Step S17 is repeated when the vessel control device 1C has determined that the fixed-point holding control of the vessel 1 is not to be stopped (specifically when the operation unit 2B of the input device 2 has not received an input of an instruction to stop the fixed-point holding control of the vessel 1 from the operator outside the vessel 1). On the other hand, the process proceeds to step S18 when the vessel control device 1C has determined that the fixed-point holding control of the vessel 1 is to be stopped (specifically when the operation unit 2B of the input device 2 has received an input of an instruction to stop the fixed-point holding control of the vessel 1 from the operator outside the vessel 1).

In step S18, the vessel control device 1C stops the fixed-point holding control of the vessel 1 and causes the actuator 1A to stop generating a propulsive force of the vessel 1 (specifically a thrust of the vessel 1 for holding the vessel 1 at the fixed-point holding target position TP2 (see FIG. 2D) against disturbances such as wind and current).

Eighth Embodiment

Hereinafter, an eighth embodiment of a vessel, a vessel control device, a vessel control method, and a program of the present invention will be described.

A vessel 1 of the eighth embodiment is configured similar to the vessel 1 of the seventh embodiment described above, except for the points described below. Thus, the vessel 1 of the eighth embodiment can achieve the same advantages as the vessel 1 of the seventh embodiment described above, except for those described below.

The vessel 1 or the like to which the vessel control device 1C of the eighth embodiment is applied is configured similar to the vessel 1 or the like to which the vessel control device 1C of the seventh embodiment shown in FIG. 10 is applied.

Figure 12:
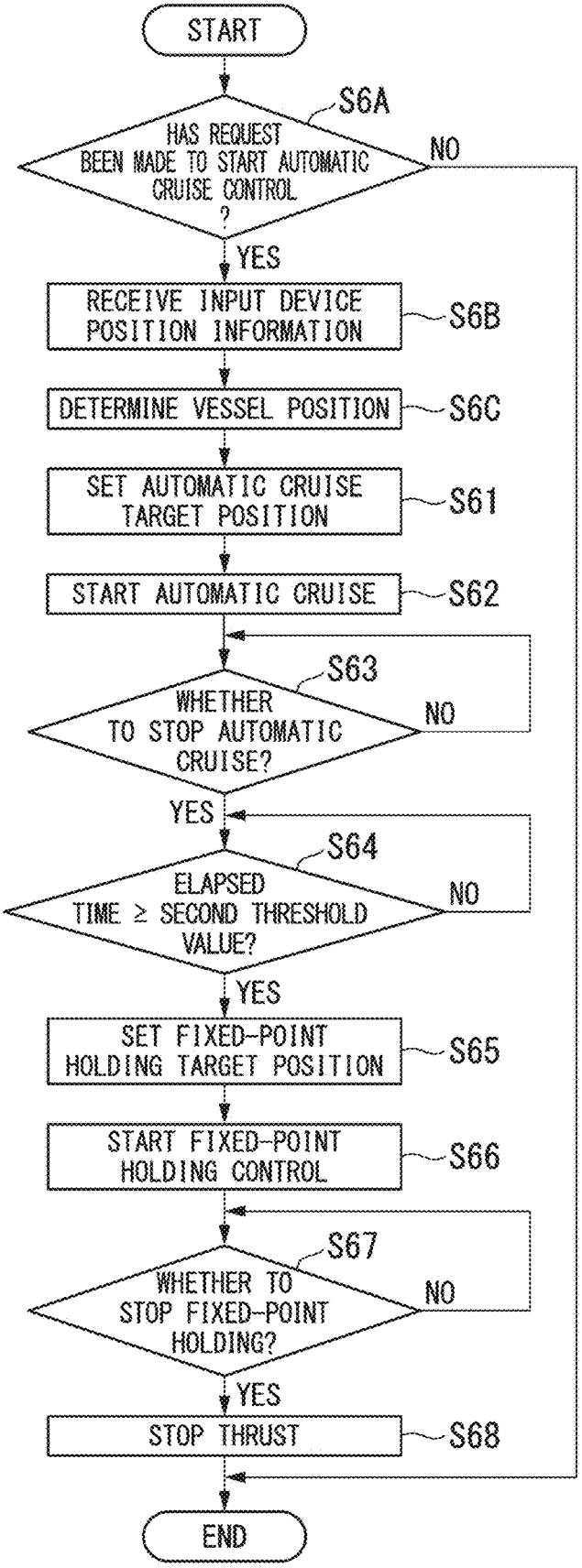
FIG. 12 is a flowchart showing an example of a process performed by a vessel or the like to which a vessel control device of an eighth embodiment is applied.

FIG. 12 is a flowchart showing an example of a process performed by the vessel 1 or the like to which the vessel control device 1C of the eighth embodiment is applied.

In the example shown in FIG. 12, in step S6A, the vessel control device 1C determines whether the operation unit 2B of the input device 2 has received a request to start automatic cruise control of the vessel 1 from an operator outside the vessel 1, similar to step S5A of FIG. 11. The process proceeds to step S6B when the operation unit 2B of the input device 2 has received a request to start automatic cruise control of the vessel 1 from the operator outside the vessel 1 (that is, when the communication unit 1H has received a request to start automatic cruise control of the vessel 1 from the operator outside the vessel 1 from the input device 2). On the other hand, the routine shown in FIG. 12 ends when the operation unit 2B of the input device 2 has not received a request to start automatic cruise control of the vessel 1 from the operator outside the vessel 1 (that is, when the communication unit 1H has not received a request to start automatic cruise control of the vessel 1 from the operator outside the vessel 1 from the input device 2).

In step S6B, the communication unit 1H receives from the input device 2 information indicating the position of the input device 2 determined by the input device position determination unit 2A of the input device 2, similar to step S5B of FIG. 11.

In step S6C, the vessel position determination unit 1D determines the position of the vessel 1, similar to step S5C of FIG. 11.

Next, in step S61, the vessel control device 1C sets (calculates) an automatic cruise target position, which is a target position of automatic cruise control of the vessel 1, based on the information indicating the position of the input device 2 received in step S6B and the position of the vessel 1 determined in step S6C, similar to step S51 of FIG. 11. Next, the process proceeds to step S62.

In step S62, the vessel control device 1C starts automatic cruise control of the vessel 1 (that is, the vessel 1 starts automatic cruise) and the vessel 1 moves toward the automatic cruise target position, similar to step S52 of FIG. 11.

Next, in step S63, the vessel control device 1C determines whether to stop the automatic cruise control of the vessel 1, similar to step S53 of FIG. 11. Step S63 is repeated when the vessel control device 1C has determined that the automatic cruise control of the vessel 1 is not to be stopped (specifically when the position of the vessel 1 determined by the vessel position determination unit 1D does not approximately match the automatic cruise target position (that is, the vessel 1 has not reached the automatic cruise target position) and the operation unit 2B of the input device 2 has not received an input of an instruction to stop the automatic cruise control of the vessel 1 from the operator outside the vessel 1). On the other hand, the process proceeds to step S64 when the vessel control device 1C has determined that the automatic cruise control of the vessel 1 is to be stopped (specifically when the position of the vessel 1 determined by the vessel position determination unit 1D approximately matches the automatic cruise target position (that is, the vessel 1 has reached the automatic cruise target position) or when the operation unit 2B of the input device 2 has received an input of an instruction to stop the automatic cruise control of the vessel 1 from the operator outside the vessel 1).

In step S64, the vessel control device 1C monitors the elapsed time since the automatic cruise control of the vessel 1 was stopped. Specifically, in step S64, the vessel control device 1C determines whether the elapsed time since the automatic cruise control of the vessel 1 was stopped is equal to or greater than a second threshold value. Step S64 is repeated when the elapsed time is not equal to or greater than the second threshold value (that is, when it can be estimated that the vessel 1 continues to move due to the inertial force (tendency to keep moving) of the vessel 1). On the other hand, the process proceeds to step S65 when the elapsed time is equal to or greater than the second threshold value (that is, when it can be estimated that the movement of the vessel 1 due to the inertial force (tendency to keep moving) of the vessel 1 has ended).

In step S65, the fixed-point holding target position setting unit 1C2 sets the position of the vessel 1 determined by the vessel position determination unit 1D as a fixed-point holding target position which is a target position of the vessel 1 where fixed-point holding control of the vessel 1 is to be performed, similar to step S55 of FIG. 11.

Next, in step S66, the vessel control device 1C starts the fixed-point holding control of the vessel 1, similar to step S56 of FIG. 11.

Next, in step S67, the vessel control device 1C determines whether to stop the fixed-point holding control of the vessel 1, similar to step S57 of FIG. 11. Step S67 is repeated when the vessel control device 1C has determined that the fixed-point holding control of the vessel 1 is not to be stopped. On the other hand, the process proceeds to step S68 when the vessel control device 1C has determined that the fixed-point holding control of the vessel 1 is to be stopped.

In step S68, the vessel control device 1C stops the fixed-point holding control of the vessel 1 and causes the actuator 1A to stop generating a thrust of the vessel 1 (specifically a thrust of the vessel 1 for holding the vessel 1 at the fixed-point holding target position against disturbances such as wind and current), similar to step S58 of FIG. 11.

That is, in the example shown in FIG. 10 and FIG. 12, when the vessel control device 1C performs automatic cruise control of the vessel 1 and then performs fixed-point holding control of the vessel 1, the fixed-point holding target position setting unit 1C2 sets a position different from the position of the vessel 1 where the automatic cruise control of the vessel 1 is stopped as the fixed-point holding target position.

Therefore, in the example shown in FIG. 10 and FIG. 12, it is possible to realize a smooth transition from automatic cruise control of the vessel 1 to fixed-point holding control of the vessel 1 while preventing generation of a thrust of the vessel 1 in a direction against the inertial force (tendency to keep moving) of the vessel 1 produced when transitioning from automatic cruise control of the vessel 1 to fixed-point holding control of the vessel 1 (that is, it is possible to make the behavior of the vessel 1 seamless), without the need to perform complicated vessel speed control at the final stage of automatic cruise control of the vessel 1 unlike the technology described in Patent Document 1.

In the example shown in FIG. 10 and FIG. 12, when stopping the automatic cruise control of the vessel 1, the vessel control device 1C stops the actuator 1A from generating a propulsive force and thrust of the vessel 1, but in another example, when stopping the automatic cruise control of the vessel 1, the vessel control device 1C may cause the actuator 1A to generate a thrust in a direction against the inertial force of the vessel 1 produced when the automatic cruise control of the vessel 1 is stopped.

In another example of a process performed by the vessel 1 or the like to which the vessel control device 1C of the eighth embodiment is applied, the same process as the process shown in FIG. 4 described above is performed.

Specifically, in step S21 of FIG. 4, the operation unit 2B of the input device 2 receives a setting of an automatic cruise target position TP1 (see FIG. 2B), which is a target position of automatic cruise control of the vessel 1, from the operator outside the vessel 1. The communication unit 2C of the input device 2 transmits information indicating the automatic cruise target position TP1 to the vessel 1.

Next, in step S22, the operation unit 2B of the input device 2 receives an input of an instruction to start automatic cruise control of the vessel 1 from the operator outside the vessel 1. The communication unit 2C of the input device 2 transmits the instruction to start automatic cruise control of the vessel 1 to the vessel 1. As a result, the vessel control device 1C starts automatic cruise control of the vessel 1 (that is, the vessel 1 starts automatic cruise), and as shown in FIG. 2A, the vessel 1 moves toward the automatic cruise target position TP1.

Next, in step S23, the vessel control device 1C determines whether to stop the automatic cruise control of the vessel 1. Step S23 is repeated when the vessel control device 1C has determined that the automatic cruise control of the vessel 1 is not to be stopped. On the other hand, the process proceeds to step S24 when the vessel control device 1C has determined that the automatic cruise control of the vessel 1 is to be stopped.

In step S24, the vessel control device 1C monitors the elapsed time since the automatic cruise control of the vessel 1 was stopped. Specifically, in step S24, the vessel control device 1C determines whether the elapsed time since the automatic cruise control of the vessel 1 was stopped is equal to or greater than a second threshold value. Step S24 is repeated when the elapsed time is not equal to or greater than the second threshold value (that is, when it can be estimated that the vessel 1 continues to move due to the inertial force (tendency to keep moving) of the vessel 1). On the other hand, the process proceeds to step S25 when the elapsed time is equal to or greater than the second threshold value (that is, when it can be estimated that the movement of the vessel 1 due to the inertial force (tendency to keep moving) of the vessel 1 has ended).

In step S25, the fixed-point holding target position setting unit 1C2 sets the position of the vessel 1 determined by the vessel position determination unit 1D as a fixed-point holding target position TP2 (see FIG. 2C) which is a target position of the vessel 1 where fixed-point holding control of the vessel 1 is to be performed.

Next, in step S26, the vessel control device 1C starts the fixed-point holding control of the vessel 1.

Next, in step S27, the vessel control device 1C determines whether to stop the fixed-point holding control of the vessel 1. Step S27 is repeated when the vessel control device 1C has determined that the fixed-point holding control of the vessel 1 is not to be stopped (specifically when the operation unit 2B of the input device 2 has not received an input of an instruction to stop the fixed-point holding control of the vessel 1 from the operator outside the vessel 1). On the other hand, the process proceeds to step S28 when the vessel control device 1C has determined that the fixed-point holding control of the vessel 1 is to be stopped (specifically when the operation unit 2B of the input device 2 has received an input of an instruction to stop the fixed-point holding control of the vessel 1 from the operator outside the vessel 1).

In step S28, the vessel control device 1C stops the fixed-point holding control of the vessel 1 and causes the actuator 1A to stop generating a thrust of the vessel 1.

Although the mode for carrying out the present invention has been described above by way of embodiments, the present invention is not limited to these embodiments at all and various modifications and substitutions may be made without departing from the spirit of the present invention. The configurations described in the above embodiments and examples may also be combined.

All or some of the functions of the parts of the vessel 1 according to the above embodiments may be implemented by recording a program for implementing the functions on a computer readable recording medium and causing a computer system to read and execute the program recorded on the recording medium. The "computer system" referred to here includes an OS or hardware such as peripheral devices.

The "computer readable recording medium" refers to a portable medium such as a flexible disk, a magneto-optical disc, a ROM, or a CD-ROM, a storage unit such as a hard disk provided in the computer system, or the like. The "computer readable recording medium" may include something that dynamically holds a program for a short time, like a communication wire in the case in which the program is transmitted via a communication line such as a telephone line or a network such as the Internet, or may include something that holds a program for a certain period of time, like an internal volatile memory of a computer system that serves as a server or a client in that case. The program may be one for implementing some of the above-described functions or one which can implement the above-described functions in combination with a program already recorded in the computer system.

While preferred embodiments of the invention have been described and illustrated above, it should be understood that these are exemplary examples of the invention and are not to be considered as limiting. Additions, omissions, substitutions, and other modifications can be made without departing from the spirit or scope of the present invention. Accordingly, the invention is not to be considered as being limited by the foregoing description and is only limited by the scope of the appended claims.

EXPLANATION OF REFERENCES

1 Vessel
1A Actuator
1A1 Rudder
1A2 Thrust generation unit
1B Operation unit
1B1 Steering unit
1B2 Throttle operation unit
1B3 Automatic cruise target position setting unit
1B4 Automatic cruise start instruction input unit
1B5 Automatic cruise stop instruction input unit
1C Vessel control device
1C1 Actuator control unit
1C2 Fixed-point holding target position setting unit
1D Vessel position determination unit
1E Heading determination unit
1F Vessel speed determination unit
1G Fall-overboard determination unit
1H Communication unit
2 Input device
2A Input device position determination unit
2B Operation unit
2C Communication unit

What is claimed is:

1. A vessel comprising:

an actuator having a function of generating a propulsive force of a vessel and a function of generating a moment of the vessel; and a vessel control device configured to operate the actuator, wherein the vessel control device is configured to be able to perform automatic cruise control of the vessel and fixed-point holding control of the vessel, the vessel control device includes a fixed-point holding target position setting unit configured to set a fixed-point holding target position that is a target position of the vessel where the fixed-point holding control of the vessel is to be performed, in a state in which the vessel control device stops the automatic cruise control of the vessel and then performs the fixed-point holding control of the vessel, the fixed-point holding target position setting unit is configured to, when the vessel control device stops the automatic cruise control of the vessel and it can be estimated that the movement of the vessel due to the vessel's inertial force has ended, set a position which is different from an automatic cruise stop position and which is estimated as a position where the movement of the vessel due to the vessel's inertial force has ended, as the fixed-point holding target position, and the automatic cruise stop position is a position of the vessel where the automatic cruise control of the vessel is stopped.

2. The vessel according to claim 1, further comprising:

a vessel position determination unit configured to determine a position of the vessel; and a vessel speed determination unit configured to determine a speed of the vessel, wherein the vessel control device is configured to, when the automatic cruise control of the vessel is stopped, cause the actuator to stop generating a propulsive force of the vessel or cause the actuator to generate a thrust in a direction against an inertial force of the vessel produced when the automatic cruise control of the vessel is stopped, and the fixed-point holding target position setting unit is configured to set a position of the vessel, determined by the vessel position determination unit when the speed of the vessel determined by the vessel speed determination unit has decreased to a first threshold value or less, as the fixed-point holding target position.

3. The vessel according to claim 1, further comprising a vessel position determination unit configured to determine a position of the vessel, wherein the vessel control device is configured to, when the automatic cruise control of the vessel is stopped, cause the actuator to stop generating a propulsive force of the vessel or cause the actuator to generate a thrust in a direction against an inertial force of the vessel produced when the automatic cruise control of the vessel is stopped, and the fixed-point holding target position setting unit is configured to set a position of the vessel, determined by the vessel position determination unit when an elapsed time since the automatic cruise control of the vessel was stopped is equal to or greater than a second threshold value, as the fixed-point holding target position.

4. The vessel according to claim 1, further comprising:

an automatic cruise stop instruction input unit configured to receive an input of an instruction to stop automatic cruise of the vessel;

a vessel position determination unit configured to determine a position of the vessel; and a vessel speed determination unit configured to determine a speed of the vessel, wherein the vessel control device is configured to, when the automatic cruise control of the vessel is stopped when the automatic cruise stop instruction input unit receives an input of an instruction to stop automatic cruise of the vessel, cause the actuator to stop generating a propulsive force of the vessel or cause the actuator to generate a thrust in a direction against an inertial force of the vessel produced when the automatic cruise control of the vessel is stopped, and the fixed-point holding target position setting unit is configured to set a position of the vessel, determined by the vessel position determination unit when the speed of the vessel determined by the vessel speed determination unit has decreased to a first threshold value or less, as the fixed-point holding target position.

5. The vessel according to claim 1, further comprising:

an automatic cruise stop instruction input unit configured to receive an input of an instruction to stop automatic cruise of the vessel; and a vessel position determination unit configured to determine a position of the vessel, wherein the vessel control device is configured to, when the automatic cruise control of the vessel is stopped when the automatic cruise stop instruction input unit receives an input of an instruction to stop automatic cruise of the vessel, cause the actuator to stop generating a propulsive force of the vessel or cause the actuator to generate a thrust in a direction against an inertial force of the vessel produced when the automatic cruise control of the vessel is stopped, and the fixed-point holding target position setting unit is configured to set a position of the vessel, determined by the vessel position determination unit when an elapsed time since the automatic cruise stop instruction input unit received an input of an instruction to stop automatic cruise of the vessel is equal to or greater than a second threshold value, as the fixed-point holding target position.

6. The vessel according to claim 1, further comprising:

a vessel position determination unit configured to determine a position of the vessel;

a vessel speed determination unit configured to determine a speed of the vessel;

a fall-overboard determination unit configured to determine a fall-overboard of an occupant of the vessel; and a communication unit configured to communicate with an input device carried by a person whose fall-overboard is to be determined by the fall-overboard determination unit, wherein the vessel control device is configured to, when the fall-overboard determination unit has determined a fall-overboard of the person to be determined, perform the automatic cruise control of the vessel that brings the vessel closer to the input device and then performs the fixed-point holding control of the vessel, the vessel control device is configured to, when the automatic cruise control of the vessel is stopped, cause the actuator to stop generating a propulsive force of the vessel or cause the actuator to generate a thrust in a direction against an inertial force of the vessel produced when the automatic cruise control of the vessel is stopped, and the fixed-point holding target position setting unit is configured to set a position of the vessel, determined by the vessel position determination unit when the speed of the vessel determined by the vessel speed determination unit has decreased to a first threshold value or less, as the fixed-point holding target position.

7. The vessel according to claim 1, further comprising:

a vessel position determination unit configured to determine a position of the vessel;

a fall-overboard determination unit configured to determine a fall-overboard of an occupant of the vessel; and a communication unit configured to communicate with an input device carried by a person whose fall-overboard is to be determined by the fall-overboard determination unit, wherein the vessel control device is configured to, when the fall-overboard determination unit has determined a fall-overboard of the person to be determined, perform the automatic cruise control of the vessel that brings the vessel closer to the input device and then performs the fixed-point holding control of the vessel, the vessel control device is configured to, when the automatic cruise control of the vessel is stopped, cause the actuator to stop generating a propulsive force of the vessel or cause the actuator to generate a thrust in a direction against an inertial force of the vessel produced when the automatic cruise control of the vessel is stopped, and the fixed-point holding target position setting unit is configured to set a position of the vessel, determined by the vessel position determination unit when an elapsed time since the automatic cruise control of the vessel was stopped is equal to or greater than a second threshold value, as the fixed-point holding target position.

8. The vessel according to claim 1, further comprising:

a vessel position determination unit configured to determine a position of the vessel;

a vessel speed determination unit configured to determine a speed of the vessel; and a communication unit configured to communicate with an input device carried by an operator outside the vessel, wherein the vessel control device is configured to, when the communication unit has received a request to start the automatic cruise control of the vessel from the input device, perform the automatic cruise control of the vessel that brings the vessel closer to the input device and then performs the fixed-point holding control of the vessel, the vessel control device is configured to, when the automatic cruise control of the vessel is stopped, cause the actuator to stop generating a propulsive force of the vessel or cause the actuator to generate a thrust in a direction against an inertial force of the vessel produced when the automatic cruise control of the vessel is stopped, and the fixed-point holding target position setting unit is configured to set a position of the vessel, determined by the vessel position determination unit when the speed of the vessel determined by the vessel speed determination unit has decreased to a first threshold value or less, as the fixed-point holding target position.

9. The vessel according to claim 1, further comprising:

a vessel position determination unit configured to determine a position of the vessel; and a communication unit configured to communicate with an input device carried by an operator outside the vessel, wherein the vessel control device is configured to, when the communication unit has received a request to start the automatic cruise control of the vessel from the input device, perform the automatic cruise control of the vessel that brings the vessel closer to the input device and then performs the fixed-point holding control of the vessel, the vessel control device is configured to, when the automatic cruise control of the vessel is stopped, cause the actuator to stop generating a propulsive force of the vessel or cause the actuator to generate a thrust in a direction against an inertial force of the vessel produced when the automatic cruise control of the vessel is stopped, and the fixed-point holding target position setting unit is configured to set a position of the vessel, determined by the vessel position determination unit when an elapsed time since the automatic cruise control of the vessel was stopped is equal to or greater than a second threshold value, as the fixed-point holding target position.

10. A vessel control device that operates an actuator having a function of generating a propulsive force of a vessel and a function of generating a moment of the vessel, wherein the vessel control device is configured to be able to perform automatic cruise control of the vessel and fixed-point holding control of the vessel, the vessel control device includes a fixed-point holding target position setting unit configured to set a fixed-point holding target position that is a target position of the vessel where the fixed-point holding control of the vessel is to be performed, in a state in which the vessel control device stops the automatic cruise control of the vessel and then performs the fixed-point holding control of the vessel, the fixed-point holding target position setting unit is configured to, when the vessel control device stops the automatic cruise control of the vessel and it can be estimated that the movement of the vessel due to the vessel's inertial force has ended, set a position which is different from an automatic cruise stop position and which is estimated as a position where the movement of the vessel due to the vessel's inertial force has ended, as the fixed-point holding target position, and the automatic cruise stop position is a position of the vessel where the automatic cruise control of the vessel is stopped.

11. A vessel control method for a vessel control device that operates an actuator having a function of generating a propulsive force of a vessel and a function of generating a moment of the vessel, the vessel control method comprising:

performing automatic cruise control of the vessel by the vessel control device;

performing fixed-point holding control of the vessel by the vessel control device; and setting, by the vessel control device, a fixed-point holding target position that is a target position of the vessel where the fixed-point holding control of the vessel is to be performed, wherein the setting includes setting, in a state in which the vessel control device stops the automatic cruise control of the vessel and then performs the fixed-point holding control of the vessel, when the automatic cruise control is stopped and it can be estimated that the movement of the vessel due to the vessel's inertial force has ended, a position which is different from an automatic cruise stop position and which is estimated as a position where the movement of the vessel due to the vessel's inertial force has ended, as the fixed-point holding target position, and the automatic cruise stop position is a position of the vessel where the automatic cruise control of the vessel is stopped.

12. A non-transitory computer-readable storage medium storing a program provided for a vessel control device that operates an actuator having a function of generating a propulsive force of a vessel and a function of generating a moment of the vessel to, the program causing a computer to:

perform automatic cruise control of the vessel;

perform fixed-point holding control of the vessel; and set a fixed-point holding target position that is a target position of the vessel where the fixed-point holding control of the vessel is to be performed, wherein the setting includes setting, in a state in which the vessel control device stops the automatic cruise control of the vessel and then performs the fixed-point holding control of the vessel, when the automatic cruise control is stopped and it can be estimated that the movement of the vessel due to the vessel's inertial force has ended, a position which is different from an automatic cruise stop position and which is estimated as a position where the movement of the vessel due to the vessel's inertial force has ended, as the fixed-point holding target position, and the automatic cruise stop position is a position of the vessel where the automatic cruise control of the vessel is stopped.

13. A vessel comprising:

an actuator having a function of generating a propulsive force of a vessel and a function of generating a moment of the vessel; and a vessel control device configured to operate the actuator, wherein the vessel control device is configured to be able to perform fixed-point holding control of the vessel, the vessel control device includes a fixed-point holding target position setting unit configured to set a fixed-point holding target position that is a target position of the vessel where the fixed-point holding control of the vessel is to be performed, in a state in which the vessel control device performs the fixed-point holding control of the vessel by stopping the generation of the propulsive force of the vessel, the fixed-point holding target position setting unit is configured to, when the actuator stops generating a propulsive force of the vessel and it can be estimated that the movement of the vessel due to the vessel's inertial force has ended, set a position which is different from a propulsive force stop position and which is estimated as a position where the movement of the vessel due to the vessel's inertial force has ended, as the fixed-point holding target position, and the propulsive force stop position is a position of the vessel where the propulsive force is stopped.

* * * * *